US005512402A

United States Patent [19]

Okado et al.

[11] Patent Number: 5,512,402

[45] Date of Patent: Apr. 30, 1996

[54] CARRIER FOR ELECTROPHOTOGRAPHY, TWO-COMPONENT TYPE DEVELOPER, AND IMAGE FORMING METHOD

[75] Inventors: Kenji Okado, Yokohama; Toshiyuki Ugai, Tokyo; Ryoichi Fujita, Kawasaki; Makoto Kanbayashi, Kawasaki; Tsuyoshi Takiguchi, Kawasaki; Yasuhiro Ichikawa, Tokyo; Wakashi Iida, Higashi Kurume, all of Japan

[73] Assignee: Canon Kabushiki Kaisha, Tokyo, Japan

[21] Appl. No.: 246,146

[22] Filed: May 19, 1994

[30] Foreign Application Priority Data

| | | | |
|---|---|---|---|
| May 20, 1993 | [JP] | Japan | 5-139925 |
| Jun. 22, 1993 | [JP] | Japan | 5-173583 |
| Jul. 13, 1993 | [JP] | Japan | 5-195309 |

[51] Int. Cl.[6] ..... G03G 9/08; G03G 9/107

[52] U.S. Cl. ..... 430/106.6; 430/108; 430/110; 430/111

[58] Field of Search ..... 430/106.6, 108, 430/111

[56] References Cited

U.S. PATENT DOCUMENTS

| | | | |
|---|---|---|---|
| 2,221,776 | 11/1940 | Carlson . | |
| 2,297,691 | 10/1942 | Carlson . | |
| 2,618,552 | 11/1952 | Wise . | |
| 2,874,063 | 2/1959 | Greig . | |
| 3,909,258 | 9/1975 | Kotz . | |
| 4,614,698 | 9/1986 | Miyakawa et al. | 430/108 X |
| 4,904,558 | 2/1990 | Nagatsuka et al. | 430/122 |
| 4,933,254 | 12/1990 | Hosoi et al. | 430/122 |
| 4,985,327 | 1/1991 | Sakashita et al. | 430/106.6 |
| 5,108,862 | 4/1992 | Kishimoto et al. | 430/108 |
| 5,256,512 | 10/1993 | Kobayashi et al. | 430/106 |
| 5,300,386 | 4/1994 | Kanbayashi et al. | 430/122 X |

FOREIGN PATENT DOCUMENTS

| | | |
|---|---|---|
| 42-23910 | 11/1967 | Japan . |
| 43-24748 | 10/1968 | Japan . |
| 49-70630 | 7/1974 | Japan . |
| 51-3238 | 1/1976 | Japan . |
| 51-3244 | 1/1976 | Japan . |
| 54-72054 | 6/1979 | Japan . |
| 58-23032 | 2/1983 | Japan . |
| 58-144839 | 8/1983 | Japan . |
| 58-129437 | 8/1983 | Japan . |
| 59-52255 | 3/1984 | Japan . |
| 60-112052 | 6/1985 | Japan . |
| 61-204646 | 9/1986 | Japan . |
| 62-63970 | 3/1987 | Japan . |
| 2-877 | 1/1990 | Japan . |
| 2-222966 | 9/1990 | Japan . |
| 2-281280 | 11/1990 | Japan . |

*Primary Examiner*—Roland Martin

*Attorney, Agent, or Firm*—Fitzpatrick, Cella, Harper & Scinto

[57] ABSTRACT

A carrier for electrophotography has carrier particles. The carrier has a 50% average particle diameter ($D_{50}$) of from 15 μm to 45 μm and contains from 1% to 20% of carrier particles with a size smaller than 22 μm, not more than 3% of carrier particles with a size smaller than 16 μm, from 2% to 15% of carrier particles with a size of 62 μm or larger, and not more than 2% of carrier particles with a size of 88 μm or larger. The carrier has a specific surface area $S_1$ as measured by an air-permeability method and a specific surface area $S_2$ as calculated by the following expression:

$$S_2=(6/\rho.D_{50})\times10^4$$

wherein ρ is a specific gravity of carrier; satisfying the following condition:

$$1.2\leqq S_1/S_2\leqq 2.0. +EA$$

26 Claims, 3 Drawing Sheets

CARRIER FOR ELECTROPHOTOGRAPHY, TWO-COMPONENT TYPE DEVELOPER, AND IMAGE FORMING METHOD

BACKGROUND OF THE INVENTION

1. Field of the Invention

The present invention relates to a carrier for electrophotography used to develop an electrostatic image in electrophotography, electrostatic recording or electrostatic printing. It also relates to a two-component developer and an image forming method.

2. Related Background Art

It is conventionally known to form an image on the surface of a photoconductive material by an electrostatic means.

A large number of methods are known as electrophotography, as disclosed in U.S. Pat. No. 2,297,691, Japanese Patent Publications No. 42-23910 and No. 43-24748 and so forth. In general, an electrostatic latent image is formed on a photosensitive member, utilizing a photoconductive material and according to various means, and subsequently a very finely divided electrodetective material called a toner is adhered to the latent image to form a toner image corresponding to the electrostatic latent image. The toner is attracted to the electrostatic latent image in accordance with the quantity of charges on a photoconductive layer, so that a toner image with a difference in density is formed.

Next, the toner image is transferred to an image holding medium such as paper if necessary, followed by fixing by the action of heat, pressure, or solvent vapor. A copy is thus obtained. In the case when the process comprises a toner-image transfer step, the process is usually provided with the step of removing the toner remaining on the photosensitive member.

As developing methods by which the electrostatic latent image is formed into a visible image by the use of a toner, known methods can be exemplified by the powder cloud development as disclosed in U.S. Pat. No. 2,221,776, the cascade development as disclosed in U.S. Pat. No. 2,618,552, the magnetic brush development as disclosed in U.S. Pat. No. 2,874,063, and the method in which a conductive magnetic toner is used, as disclosed in U.S. Pat. No. 3,909,258, as well as what is called the J/B development as disclosed in Japanese Patent Application Laid-open No. 62-63970, in which a bias electric field comprised of an AC component and a DC component is applied across a developer carrying member (a developing sleeve) and a photoconductive layer to carry out development.

Among these, the magnetic brush development can be noted as a representative process. In this process, magnetic particles such as steel powder or ferrite powder are used as a carrier, and a developer comprised of a toner and such a magnetic carrier is held with a magnet so that the developer is arranged in the form of a brush by the action of a magnetic field of the magnet. The magnetic brush thus formed is brought into contact with the electrostatic latent image surface on a photoconductive layer, whereupon only the toner is attracted toward the electrostatic latent image from the brush to carry out development.

As toners used in these developing methods, a fine powder obtained by mixing and dispersing a colorant in a thermoplastic resin has been commonly used. The thermoplastic resin most commonly includes polystyrene resins.

Besides, polyester resins, epoxy resins, acrylic resins and urethane resins are also used. As the colorant, carbon black is most widely used. In the case of magnetic toners, black magnetic powders of an iron oxide type are widely used. In a system in which what is called the two-component type developer is used, the toner is usually used by its mixture with carrier particles such as glass beads and iron powder.

The toner image finally formed on a copy image holding medium such as paper is permanently fixed onto the image holding medium by the action of heat and/or pressure. In this fixing, the step of fixing by heat has been hitherto widely used.

In the case when the process comprises a toner-image transfer step, the process is usually provided with the step of removing the toner remaining on the photosensitive member.

In recent years, a rapid progress is being made from monochromatic copying to full-color copying, and researches are made on two-color copying machines or full-color copying machines, which have been already put into practical use. For example, Journal of Electrophotographic Society, Vol. 22, No. 1 (1983) and Journal of Electrophotographic Society, Vol. 25, No. 1, p. 52 (1986) make reports relating to color reproduction and gradation reproduction.

Images formed by full-color electrophotography presently put into practical use, however, are not necessarily satisfactory for those who are accustomed to seeing color pictures that are by no means immediately compared with the actual object or original and also processed more beautifully than the actual object or original, as in television pictures, photographs and color prints.

Moreover, in recent years, there is an increasing commercial demand for making copying machines have a higher minuteness and making images have a higher quality. In the present technical field, it is attempted to make toner particle diameter smaller so that a color image can be formed in a high image quality. Making smaller the particle diameters of toner particles results in an increase in the surface area per unit weight, tending to bring about an excessively large quantity of triboelectricity of the toner. This is accompanied with a possibility of the insufficiency of image density or the deterioration of durability or running performance.

Namely, in the aforesaid development of electrostatic latent images, the toner is blended with a carrier formed of relatively large particles and is used as a developer for electrophotography. The composition of both the toner and the carrier is selected so that as a result of their mutual contact friction the toner can have a polarity reverse to the charges present on the photoconductive layer. As a result of contact friction between the both, the carrier electrostatically attracts the toner to its particle surfaces to transport the toner as a developer through a developing assembly and also feed the toner onto the photoconductive layer. When, however, copies are continuously taken on a large number of copy sheets by an electrophotographic copying apparatus using such a two-component type developer, although sharp images with a good image quality can be obtained at the initial stage, edge effect with much fog may seriously occur after copies have been taken on several tens of thousands of sheets, resulting in images having poor gradation and sharpness.

In color copying carried out using toners with chromatic colors, continuous gradation is an important factor that influences image quality, and the edge effect that stresses only margins of images, occurring after copies have been taken on a large number of copy sheets, greatly damages the gradation of images. For example, quasi-contours due to the edge effect are formed in the vicinity of actual contours, resulting in a loss of reproducibility including color reproducibility in color copying. Image area used in conventional black and white copying is 10% or less and images are almost held by line images as in letters, documents, reports and so forth. On the other hand, in the case of color copying, image area is 20% at least, and images are held by gradational solid images at a reasonable frequency or occupancy as in photographs, catalogues, maps, pictures and so forth.

When copies are continuously taken using such originals having a large image area, reproductions with a high image density can be obtained at the initial stage in usual instances, but the feeding of toner to the two-component type developer may become insufficient with time to cause a decrease in density, or the toner being fed and the carrier may mix in the state of charge insufficiency to cause fog or cause a local increase or decrease in toner concentration (which indicates toner-Carrier mixing ratio) on the developing sleeve, tending to result in bluffed images or non-uniform image density. This tendency becomes more remarkable when the toner has a smaller particle diameter.

Such under-development and fog are presumed to be caused by an excessively low toner content (i.e., toner concentration) in developer or a poor rise for rapid triboelectric charging between the toner being fed and the carrier contained in the two-component type developer, where any uncontrollable, insufficiently charged toner thereby produced participates in development. It is essential for color developers to have the ability to always output images with a good image quality in the continuous copying of originals having a large image area. To deal with originals having a large image area and requiring a very large toner consumption, measures hitherto taken have more relied on improvements of developing apparatus than improvements of developers themselves. That is, it has been attempted to increase the peripheral speed of a developing sleeve or make a developing sleeve have a larger diameter so that the developing sleeve can be brought into contact with electrostatic latent images more times.

Such measures can be effective for improving developability, but may greatly limit the lifetime of apparatus because of an in-machine contamination due to toner scatter from developing assemblies or because of an overload on the drive of developing assemblies. In some instances, measures are also taken in which developers are put in developing assemblies in large quantities in order to compensate the insufficiency of developability of the developers. Such measures, however, cause an increase in weight of copying machines, a cost increase due to the apparatus that must be made larger in size and an overload on the drive of developing assemblies as in the above case, and are not so much preferable.

Now, studies are reported on improvements made from both directions Of toners and carriers for the purpose of maintaining a high image quality over a long period of running.

More specifically, for the purpose of improving image quality, several developers are proposed. For example, Japanese Patent Application Laid-open No. 51-3244 discloses a non-magnetic toner in which its particle size distribution is controlled so that the image quality can be improved. This toner is mainly composed of toner particles having a particle diameter of 8 to 12 μm, which are relatively coarse. According to studies made by the present inventors, it is difficult to "lay" the toner with such particle diameter onto latent images in a uniform and dense state, and also the toner, as having the feature that particles with a size of 5 μm or smaller are in an amount of not more than 30% by number and particles with a size of 20 μm or larger are in an amount of not more than 5% by number, tends to cause a lowering of uniformity because of a broadness of its particle size distribution. In order to form sharp images by the use of the toner comprised of such relatively coarse toner particles and having a broad particle size distribution, the toner particles must be thickly overlaid so that any spaces between toner particles can be filled up to increase apparent image density. This brings about the problem of an increase in the consumption of toner necessary to attain a given image density.

Japanese Patent Application Laid-open No. 54-72054 discloses a non-magnetic toner having a sharper particle size distribution than the above toner. This toner, however, contains medium-size particles with a size of as large as 8.5 to 11.5 μm, and has room for further improvement for a toner with a high resolution.

Japanese Patent Application Laid-open No. 58-129437 discloses a non-magnetic toner having an average particle diameter of 6 to 10 μm and held by particles with a size of 5 to 8 μm in the greatest number. This toner, however, contains particles with a size of 5 μm or smaller in an amount of as small as 15% by number or less, and tends to form images lacking in sharpness.

As a result of studies made by the present inventors, they have discovered that toner particles with a size of 5 μm or smaller contribute the clear reproduction of contours of latent images and have a chief function of densely "laying" the toner onto the whole latent image. In particular, electrostatic latent images on a photosensitive member have a higher electric field intensity at their edges, the contours, than at their inner sides because of concentrated lines of electric force, and the quality of toner particles gathering at the contours influences the sharpness of image quality. The studies made by the present inventors have revealed that the control of the quantity of toner particles with a size of 5 μm or smaller is effective for solving the problems concerning the sharpness of image quality.

Accordingly, the present inventors have proposed in Japanese Patent Application Laid-open No. 2-222966 a toner containing toner particles with a size of 5 μm or smaller in an amount of 15 to 40% by number. This has brought about a reasonable improvement in image quality, but it is sought to achieve a more improved image quality.

Japanese Patent Application Laid-open No. 2-877 discloses a toner containing toner particles with a size of 5 μm or smaller in an amount of 17 to 60% by number. This has certainly brought about stable image quality and image density, but it has been found that, when originals requiring a large toner consumption as in photograph originals are continuously copied, the particle size distribution of toner may change if measures are taken from the direction of toners only, making it difficult to obtain always stable images.

Meanwhile, Japanese Patent Applications Laid-open No. 51-3238, No. 58-144839 and No. 61-204646 suggest average particle diameter and particle size distribution of carriers. Of these, Japanese Patent Application Laid-open No. 51-3238 makes reference to a rough particle size distribution. It, however, has no specific disclosure as to magnetic properties closely concerned with developing performance of developers or transport performance thereof in developing apparatus. Moreover, carriers used in Examples all contain particles with a size of 250 meshes or larger in an amount of as large as about 80% by weight or more and also have an average particle diameter of 60 μm or larger.

Japanese Patent Application Laid-open No. 58-144839 only discloses average particle diameter of a carrier. It does not make reference to the quantity of fine powder that influences the adhesion of carriers to photosensitive members and the quantity of coarse powder that influences the sharpness of images. It does not take account of performance of color copying, and has no detailed disclosure as to particle size distribution of carriers. As for Japanese Patent Application Laid-open No. 61-204646, it discloses as the gist of the invention a combination of a copying machine with a suitable developer, and has no specific disclosure as to the particle size distribution or magnetic properties of carriers. It also has no disclosure as to why the developer is effective for the copying machine.

Japanese Patent Application Laid-open No. 49-70630 has a disclosure relating to magnetic force of carriers, which, however, is concerned with iron powders used as carrier materials, having a larger specific gravity than ferrites, also having a high saturation magnetization. Iron powder carriers have been hitherto put into wide use, but tend to make the weight of copying macklines larger or cause an overload on drive torque, and also have a large environmental dependence.

A ferrite carrier disclosed in Japanese Patent Application Laid-open No. 58-23032 concerns a porous material with many voids. Such a carrier tends to cause the edge effect, having a poor durability, and has been found to be unsuitable for color copy carriers.

It has long been sought to provide a developer that enables continuous reproduction of images with a large image area, using a developer in a small quantity, and can satisfy the performance specific to color copying that no edge effect may occur even after running. Studies are made on developers and carriers, almost all of which, however, are proposed taking account of black and white copying, and only a little of which are proposed as those applicable also to full-color copying. It is also sought to provide a carrier having the ability to continue reproduction of images having an image area of 20% or more, which are nearly solid images, and having the ability to decrease the edge effect and retain the uniformity of image density on a sheet of reproduction.

Under such circumstances, the present inventors have proposed, as disclosed in Japanese Patent Application Laid-open No. 2-281280, a carrier with a narrow particle size distribution in which the presence of fine powder and the presence of coarse powder have been quantitatively controlled, to achieve a carrier improved in developing performance.

However, as previously stated, there is an increasing commercial demand for making copying machines have a higher minuteness and making images have a higher quality. In the present technical field, it is attempted to make toner particle diameter smaller so that a color image can be formed in a high image quality. Making smaller the particle diameters of toner particles results in an increase in the surface area per unit weight, tending to bring about an excessively large quantity of triboelectricity of the toner. This is accompanied with a possibility of the insufficiency of image density or the deterioration of running performance.

Thus, for the purpose of preventing the insufficiency of image density or the deterioration of running performance, caused by the toner made to have a smaller particle diameter, or for the purpose of improving development efficiency, it is attempted to make carrier particles have a smaller diameter. Such carriers, however, have achieved no quality high enough to stand against changes in the environment of toners or changes in the quantity of triboelectricity after running, and, under existing circumstances, it is difficult to achieve all the high image density, high image quality and good anti-fogging and prevention of carrier adhesion.

SUMMARY OF THE INVENTION

An object of the present invention is provide a carrier for electrophotography, a two-component developer and an image forming method, that have solved the problems discussed above.

That is, an object of the present invention is to provide a carrier for electrophotography, a two-component developer and an image forming method, that may cause no decrease in image density and no bluffed images even when color originals with a large image area are continuously copied.

Another object of the present invention is to provide a carrier for electrophotography, a two-component developer and an image forming method, that can achieve fog-free, sharp image characteristics and a superior running stability.

Still another object of the present invention is to provide a carrier for electrophotography, a two-component developer and an image forming method, that can enjoy a rapid rise of triboelectrio charging between toner and carrier.

A further object of the present invention is to provide a carrier for electrophotography, a two-component developer and an image forming method, that can have less dependence of triboelectric charging on environment.

A still further object of the present invention is to provide a carrier for electrophotography, a two-component developer and an image forming method, that can achieve a good transport performance in developing assemblies.

A still further object of the present invention is to provide an image forming method that can be influenced with difficulty by environmental factors such as temperature and humidity, and have always stable developing performance.

A still further object of the present invention is to provide an image forming method that can obtain color images having a high quality with a high image density and superior highlight reproduction and fine-line reproduction.

The present invention provides a carrier for electrophotography comprising carrier particles, wherein said carrier has a 50% average particle diameter ($D_{50}$) of from 15 μm to 45 μm; said carrier contains from 1% to 20% of carrier particles with a size smaller than 22 μm, not more than 3% of carrier particles with a size smaller than 16 μm, from 2% to 15% of carrier particles with a size of 62 μm or larger, and not more than 2% of carrier particles with a size of 88 μm or larger; and said carrier has a specific surface area $S_1$ as measured by an air-permeability method and a specific surface area $S_2$ as calculated by the following expression:

$$S_2=(6/\rho.D_{50})\times10^4$$

wherein ρ is a specific gravity of carrier; satisfying the following condition:

$$1.2\leqq S_1/S_2\leqq 2.0.$$

The present invention also provides a two-component type developer comprising a toner and a carrier, said carrier comprising carrier particles, wherein said carrier has a 50% average particle diameter ($D_{50}$) of from 15 μm to 45 μm; said carrier contains from 1% to 20% of carrier particles with a size smaller than 22 μm, not more than 3% of carrier particles with a size smaller than 16 μm, from 2% to 15% of carrier particles with a size of 62 μm or larger, and not more than 2% of carrier particles with a size of 88 μm or larger; and said carrier has a specific surface area $S_1$ as measured by an air-permeability method and a specific surface area $S_2$ as calculated by the following expression:

$$S_2=(6/\rho.D_{50})\times10^4$$

wherein ρ is a specific gravity of carrier; satisfying the following condition:

$$1.2\leqq S_1/S_2\leqq 2.0.$$

The present invention still also provides an image forming method comprising;

developing in a developing zone defined by a latent image bearing member and a developer carrying member provided opposingly thereto, a latent image boared on the latent image bearing member, using a toner of a two-component type developer carried in the developer carrying member and comprising a toner and a carrier; said carrier comprising carrier particles, wherein;

said carrier has a 50% average particle diameter ($D_{50}$) of from 15 μm to 45 μm; said carrier contains from 1% to 20% of carrier particles with a size smaller than 22 μm, not more than 3% of carrier particles with a size smaller than 16 μm, from 2% to 15% of carrier particles with a size of 62 μm or larger, and not more than 2% of carrier particles with a size of 88 μm or larger; and said carrier has a specific surface area $S_1$ as measured by an air-permeability method and a specific surface area $S_2$ as calculated by the following expression:

$$S_2=(6/\rho.D_{50})\times10^4$$

wherein ρ is a specific gravity of carrier; satisfying the following condition:

$$1.2\leqq S_1/S_2\leqq 2.0.$$

The present invention further provides an image forming method comprising;

forming in a developing zone defined by a latent image bearing member and a developer carrying member provided opposingly thereto, a developing electric field between the latent image bearing member and the developer carrying member by applying to the developer carrying member a first voltage for directing a toner from the latent image bearing member toward the developer carrying member, a second voltage for directing the toner from the developer carrying member toward the latent image bearing member and a third voltage intermediate between the first voltage and the second voltage, to develop a latent image beared on the latent image bearing member, using a toner of a developer carried on the developer carrying member, wherein;

said toner contains at least colorant-containing resin particles and an external additive; said toner has a weight average particle diameter of from 3 μm to 7 μm; and said toner contains more than 40% by number of toner particles with a particle diameter of 5.04 μm or smaller, from 10% to 70% by number of toner particles with a particle diameter of 4 μm or smaller, from 2% to 20% by volume of toner particles with a particle diameter of 8 μm or larger, and not more than 6% by volume of toner particles with a particle diameter of 10.08 μm or larger.

DESCRIPTION OF THE PREFERRED EMBODIMENTS

Figure 1:
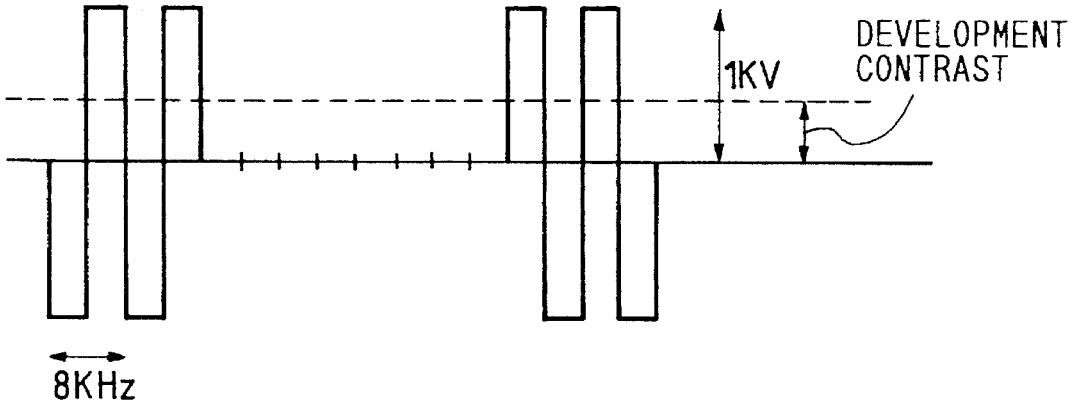
FIG. 1 shows a pattern of a discontinuous developing electric field used in Example 11.

The present inventors have discovered that images can be made to have a high image quality with a high image density and superior highlight reproduction and fine-line reproduction when a carrier having specific particle size distribution and surface properties is used.

The carrier for electrophotography of the present invention is a carrier with a uniform and small particle diameter, having a small average particle diameter and in which the presence of fine powder and the presence of coarse powder have been quantitatively controlled. It is also a carrier whose particle surfaces have been made uneven to a certain extent. Hence, it contributes a good transport performance of toner, and can achieve a preferably improved rise for triboelectric charging with toner.

The carrier for electrophotography of the present invention will be described in greater detail.

The carrier of the present invention has a 50% average particle diameter of from 15 μm to 45 μm, and contains, as fine powder, from 1% to 20%, preferably from 2% to 15% and more preferably from 4% to 12% of carrier particles with a size smaller than 22 μm, and not more than 3%, preferably not more than 2% and more preferably not more than 1% of carrier particles with a size smaller than 16 μm.

If the content of fine powder exceeds the above values, the carrier adhesion may occur or the smooth charging with toner may be prohibited. If the carrier particles with a size smaller than 22 μm are in a content less than 1%, the magnetic brush may become rough to make the toner have a poor rise of charging, causing toner scatter and fog.

As coarse powder, the content of carrier particles with a size of 62 μm or larger closely correlates with the sharpness of images. Hence, the carrier must contain 2 to 15% of such carrier particles. If their content is more than 15%, the carrier may lower the transport performance of the toner to cause an increase in the scatter of toner on non-image areas, resulting in a lowering of resolution of images and a lowering of highlight reproduction. If it is less than 2%, the developer may have a poor fluidity to cause a local or uneven distribution of the developer inside the developing assembly, making it difficult to obtain stable images.

The carrier of the present invention also contains not more than 2% of carrier particles with a size of 88 μm or larger.

The carrier of the present invention is also characterized by having a specific surface area $S_1$ as measured by an air-permeability method and a specific surface area $S_2$ as calculated by the following expression I:

$$S_2=(6/\rho.D_{50})\times10^4 \quad \text{Expression I}$$

wherein ρ is a specific gravity of carrier; in the ratio of $S_1/S_2$ of from 1.2 to 2.0, preferably from 1.3 to 1.8, and more preferably from 1.4 to 1.7.

If the ratio $S_1/S_2$ is smaller than 1.2, the surfaces of carrier particles become smooth to cause a lowering of the transport performance of the toner, so that toner scatter, fog, image non-uniformity and so forth may occur. If the ratio $S_1/S_2$ is larger than 2.0, the surfaces of carrier particles become excessively uneven to tend to cause a non-uniformity when the carrier particle surfaces are treated with resin or the like, so that it may become impossible to achieve uniform charging, tending to cause fog and toner scatter as well as carrier adhesion.

The carrier for electrophotography of the present invention may preferably also have a saturation magnetization of from 35 to 90 emu/g, a residual magnetization of 10 emu/g or less and a coercive force of 40 oersteds or less, with respect to an applied magnetic field of 3,000 oersteds. If the carrier has a saturation magnetization of more than 90 emu/g (with respect to an applied magnetic field of 3,000 oersteds), brushlike ears formed of the carrier and the toner on a developing sleeve provided opposingly to the electrostatic latent image formed on a photosensitive member may rise in a tight state to cause a poor gradation or half-tone reproduction. If it has a saturation magnetization of less than 35 emu/g, it may become difficult for the toner and carrier to be well carried on the developing sleeve, tending to cause the problem of carrier adhesion or serious toner scatter. If the carrier has excessively high residual magnetization and coercive force, the developer may be prohibited from being well transported through a developing assembly, tending to cause faulty images such as blurred images and density non-uniformity in solid images to make developability poor. Hence, in order to maintain the developing performance in color copying, different from usual black and white copying, it is important for the carrier to have a residual magnetization of 10 emu/g or less, preferably 5 emu/g or less, and more preferably substantially 0, and a coercive force of 40 oersteds or less (with respect to an applied magnetic field of 3,000 oersteds), preferably 30 oersteds or less, and more preferably 10 oarsteds or less.

The carrier for electrophotography of the present invention is blended with the toner so that they are used as a two-component type developer. Hence, the carrier particle surfaces may preferably be coated with a coating resin in view of the advantages that the carrier can have a longer lifetime and can have a stable ability to impart charges to the toner.

The coating resin with which the carrier particle surfaces are coated may be appropriately selected from electrical insulating resins, taking account of the relation between toner materials and carrier core materials. In the present invention, in order to improve the adhesion to carrier core materials, the coating resin with which the carrier particle surfaces are coated must contain at least one monomer selected from at least acrylic acid (or acrylate) monomers and mathacrylic acid (or methacrylate) monomers. Especially when polyester resin particles with a high negative chargeability are used as a toner material, the coating resin may preferably be in the form of a copolymer with a styrene monomer so that the charging can be made stable, where the styrene monomer may preferably be used in a copolymerization weight ratio of from 5 to 70% by weight.

The carrier particle surfaces can be coated with the resin by any methods including a method in which a coating material such as resin is dissolved or suspended in a solvent and the resulting solution or suspension is applied to the carrier particle surfaces, and a method in which these are merely mixed in powdery forms.

The monomer for the coating resin of carrier core materials, usable in the present invention may include styrene type monomers as exemplified by styrene, chlorostyrene, α-methylstyrene, and styrene-chlorostyrene; acrylic monomers as exemplified by acrylate monomers such as methyl acrylate, ethyl acrylate, butyl acrylate, octyl acrylate, phenyl acrylate and 2-ethylhexyl acrylate; and methacrylate monomers such as methyl methacrylate, ethyl methacrylate, butyl methacrylate and phenyl methacrylate.

As the carrier core materials (magnetic particles) usable in the present invention, it is possible to use, for example, surface-oxidized or surface-unoxidized metals such as iron, nikel, copper, zinc, cobalt, manganese, chromium and rare earth elements, alloys or oxides and ferrites of these. Ferrites comprising metals selected from zinc, copper, nickel and cobalt can be preferably used in view of magnetic properties. There are no particular limitations on the production process for these.

In the present invention, the specific particle size distribution as previously described may be controlled by any methods so long as they are means by which the stated particle size distribution can be satisfied, and may preferably be controlled by sieving on the coarse powder side and controlled by air classification on the fine powder side.

The two-component type developed of the present invention is obtained by blending a toned and the carrier having the specific particle size distribution described above.

The toner comprises colorant-containing resin particles containing a binder resin and a colorant, and an external additive.

The toner used in the present invention may preferably have a weight average particle diameter of from 3 μm to 7 μm, and the toner may preferably contain toner particles with a particle diameter of 5.04 μm or smaller in an amount of more than 40% by number, more preferably from mole than 40% by number to not more than 90% by number, and still more preferably from more than 40% by number to not more than 80% by number, may preferably contain toner particles with a particle diameter of 4 μm or smaller in an amount of from 10% to 70% by number, and more preferably from 15% to 60% by number, may preferably contain toner particles with a particle diameter of 8 μm or larger in an amount of from 2% to 20% by volume, and more preferably from 3.0% to 18.0% by volume, and may preferably contain toner particles with a particle diameter of 10.08 μm or larger in an amount of not more than 6% by volume.

Namely, since the carrier of the present invention as described above have been made to have smaller particle diameters than conventional carriers, the carrier itself has a lower fluidity, but its use in combination with the toner having the specific particle size distribution as described above can achieve uniform charging, bring about an improvement in the fluidity required for developers and an improvement in image quality because of formation of a dense magnetic brush, and at the same time better prevent the carrier adhesion because of an impact made milder when the magnetic brush is brought into contact with the latent image bearing member.

If the toner particles with a particle diameter of 4 μm or smaller are contained in an amount of less than 10% by number, non-magnetic toner particles effective for a high image quality become short to cause a decrease in effective non-magnetic carrier particle components as the toner is consumed when copying or printing out is continued, resulting in a loss of balance in the particle size distribution of the non-magnetic toner to give a possibility of a gradual lowering of image quality. This remarkably tends to occur when the toner is used in combination with the carrier of the present invention. If the toner particles with a particle diameter of 4 μm or smaller are contained in an amount more than 70% by number, the agglomeration between toner particles tends to occur to tend to form toner masses having particle diameters larger than those originally intended, so that images formed may be rough, the resolution may be lowered, or latent images may have a large difference in density between their edges and inner sides to tend to provide images with slightly blank areas.

If the toner particles with a particle diameter of 8 μm or larger are contained in an amount of more than 20% by volume, the image quality may become poor, and excessive development, i.e., over-application of toner may occur to cause an increase in toner consumption. If the toner particles with a particle diameter of 8 μm or larger are contained in an amount of less than 2% by volume, there is a possibility of a lowering of image characteristics because of a decrease in fluidity whatever the formulation of toner is designed.

In order to make the present invention much better effective, the toner may preferably contain toner particles with a particle diameter of 5.04 μm or smaller in an amount of more than 40% by number to not more than 90% by number, and more preferably more than 40% by number to not more than 80% by number, and may also contain toner particles with a particle diameter of 10.08 μm or larger in an amount of from 0 to 6% by volume, and preferably from 0 to 4% by volume.

As described above, the use of the developer satisfying the above condition can bring about an improvement in dot reproduction in highlight latent images, and can better prevent formation of coarse images. Moreover, since the magnetic brush in the developing zone becomes dense, halftone or solid images free of any irregularities ascribable to the state of its contact with the latent image bearing member can be attained.

As the external additive used in the two-component type developer by its mixture with the carrier having the specific particle size distribution as described above, fine particles such as silica or titanium oxide commonly used as a fluidity improver may be used. When used in combination with the above carrier, it is preferable to use fine particles of titanium oxide and is particularly preferable to use fine particles of anatase type titanium oxide having been surface-treated while hydrolyzing a coupling agent in an aqueous system, which are very effective for stabilizing charge and providing fluidity.

This is because, while the fine silica particles have a strong negative chargeability in themselves, the fine titanium oxide particles have substantially a neutral chargeability. It has been hitherto proposed to add hydrophobic titanium oxide. However, the fine titanium oxide particles have originally a smaller surface activity than silica, and have not necessarily been made well hydrophobic. Although hydrophobicity may increase when a treating agent is used in a large quantity or a highly viscous treating agent is used, the particles may coalesce one another or the fluidity-providing performance may decrease. Thus, both the stabilization of charge and the providing of fluidity have not necessarily been achieved at the same time.

Meanwhile, hydrophobic silica certainly has a good fluidity-providing performance, but may inversely cause electrostatic agglomeration because of its strong chargeability when contained in a large quantity, resulting in a decrease in the fluidity-providing performance. In this regard, the titanium oxide can more improve the fluidity of toner with its increase in quantity.

Use of anatase type titanium oxide is disclosed in, for example, Japanese Patent Application Laid-open No. 60-112052. The anatase type titanium oxide, however, has a volume resistivity of as small as about $10^7$ Ω.cm, and hence its use as it is may cause a quick leak of charge especially in an environment of high humidity. Thus, it can not necessarily be satisfactory in view of charge stabilization, and has been sought to be improved.

As an example of incorporating hydrophobic titanium oxide into a toner, Japanese Patent Application Laid-open No. 59-52255 also discloses a toner containing titanium oxide treated with an alkyltrialkoxysilane. Although the addition of titanium oxide has certainly brought about an improvement in electrophotographic performances, the titanium oxide originally has so small a surface activity that coalescent particles may occur at the stage of treatment or it may have been made nonuniformly hydrophobic, and hence can not necessarily be satisfactory when used in full-color toners.

The present inventors made extensive studies on the stability of chargeability of toners. As a result, they have discovered that an anatase type titanium oxide having been treated while hydrolyzing a coupling agent in an aqueous system, having an average particle diameter of from 0.01 to 0.2 μm, a hydrophobicity of from 20 to 98% and a light transmittance of 40% or more at 400 nm, enables homogeneous hydrophobic treatment and can be free of coalescence of particles, and discovered that a toner containing such a titanium oxide is very effective for stabilizing charges and providing fluidity.

More specifically, anatase type fine titanium oxide particles are surface-treated in an aqueous system while mechanically dispersing them so as to be formed into primary particles and while hydrolyzing a coupling agent. Such treatment makes it harder to cause the coalescence of particles than their treatment in a gaseous phase and also the treatment makes the particles mutually undergo static repulsion, so that the anatase type fine titanium oxide particles can be surface-treated substantially in the state of primary particles.

In addition, in order to apply a mechanical force so that the fine titanium oxide particles are dispersed to be formed into primary particles when the surfaces of titanium oxide particles are treated while hydrolyzing a coupling agent in an aqueous system, it is unnecessary to use coupling agents such as chlorosilanes or silazanes that may generate gas. Moreover, it becomes possible to use a highly viscous coupling agent that has not been usable because of coalescence of particles in a gaseous phase, so that the particles can be greatly effectively made hydrophobic.

The above coupling agent may include any of silane coupling agents and titanium coupling agents. Silane coupling agents are particularly preferably used, which are those represented by the formula:

$$R_mSiY_n$$

wherein R is an alkoxyl group; m is an integer of 1 to 3; Y is an alkyl group, or a hydrocarbon group containing a vinyl group, a glycidoxyl group or a methacrylic group; and n is an integer of 1 to 3;

and may include, for example, vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

The coupling agent may more preferably be represented by $C_aH^2_{a+1}$—$Si(OC_bH_{2b+1})_3$, wherein a is 4 to 12 and b is 1 to 3.

Here, if a in the formula is smaller than 4, the treatment becomes easier but no satisfactory hydrophobicity can be achieved. If a is larger than 12, a satisfactory hydrophobicity can be achieved but the coalescence of titanium oxide particles may increase, resulting in a lowering of fluidity-providing performance.

If b is larger than 3, the reactivity may become lower to make the particles insufficiently hydrophobic. Hence, a in the above formula should be 4 to 12, and preferably 4 to 8, and b should be 1 to 3, and preferably 1 or 2.

The particles may be treated in an amount of from 1 to 50% by weight, and preferably from 3 to 40% by weight, based on 100 parts by weight of the titanium oxide, and may be made to have a hydrophobicity of from 20 to 98%, preferably from 30 to 90%, and more preferably from 40 to 80%.

That is, if the hydrophobicity is less than 20%, charges may greatly decrease when the toner is left to stand for a long period of time in an environment of high humidity, so that a mechanism for charge acceleration becomes necessary on the side of hardware, resulting in a complicated apparatus. If the hydrophobicity is more than 98%, even use of anatase type titanium oxide having a small volume resistivity makes it difficult to control the charging of titanium oxide itself, resulting in charge-up of the toner in an environment of low humidity.

In view of the fluidity-providing performance, the above titanium oxide should have a particle diameter of from 0.01 to 0.2 μm. If it has a particle diameter larger than 0.2 μm, the toner may be nonuniformly charged because of a poor fluidity, so that toner scatter and fog may occur. If it has a particle diameter smaller than 0.01 μm, the particles tend to be buried in toner particle surfaces to cause an early deterioration of the toner, resulting in a lowering of durability or running performance inversely. This more remarkably tends to occur in the case of a sharp-melting color toner used in the present invention.

The above titanium oxide may be treated by a method in which it is treated in an aqueous system by hydrolyzing the coupling agent while the titanium oxide is mechanically dispersed to be formed into primary particles. This method is effective and is preferable also in view of the use of no solvent.

The titanium oxide treated in the manner as described above may preferably have a light transmittance of 40% or more at a light wavelength of 400 nm.

Namely, it is preferable for the titanium oxide used in the present invention to have a primary particle diameter of as small as 0.2 to 0.01 μm. When, however, actually incorporated into the toner, the titanium oxide is not necessarily dispersed in the form of primary particles, and may sometimes be present in the form of secondary particles. Hence, whatever the primary particle diameter is small, the above treatment may become less effective if the particles behaving as secondary particles has a large effective diameter. Nevertheless, titanium oxide having a higher light transmittance at 400 nm which is the minimum wavelength in the visible region has a correspondingly smaller secondary particle diameter. Thus, good effects can be expected for the fluidity-providing performance, the sharpness of projected images in OHP, etc.

The reason why 400 nm is selected is that it is a wavelength at a boundary region between ultraviolet and visible, and also it is said that light passes through particles with a diameter not larger than ½ of light wavelength. In view of these, any transmittance at wavelengths beyond 400 nm becomes higher as a matter of course and is not so meaningful.

The present inventors have also ascertained by X-ray diffraction, that the titanium oxide has the crystal form of an ariarase type in which lattice constant (a) is 3.78 Å and lattice constant (b) is 9.49 Å.

Meanwhile, as a method for obtaining hydrophobic fine titanium oxide particles, a method is also known in which a volatile titanium alkoxide or the like is oxidized at a low temperature to make it spherical, followed by surface treatment to obtain an amorphous spherical titanium oxide. This method, however, requires a high cost because of an expensive starting materials and a complicated production apparatus.

The titanium oxide described above preferably acts when used in combination with the colorant-containing resin particles (i.e., the toner particles) according to the present invention, having the particle size distribution as previously described. That is, the surface area per weight increases as the toner particles are made to have a smaller particle diameter, tending to cause excessive charging due to rubbing friction. AS a countermeasure for it, the fine titanium oxide particles capable of controlling charging and imparting fluidity are greatly effective. The titanium oxide preferably used in the present invention may be contained in an amount of from 0.5 to 5% by weight, preferably from 0.7 to 3% by weight, and more preferably from 1.0 to 2.5% by weight As the binder material used in the colorant-containing resin particles of the present invention, various material resins known as toner binder resins for electrophotography can be used.

For example, it may include polystyrene, styrene copolymers such as a styrene/butadiene copolymer and a styrene/acrylate copolymer, polyethylene, ethylene copolymers such as an ethylene/vinyl acetate copolymer and an ethylene/vinyl alcohol copolymer, phenol resins, epoxy resins, acrylphthalate resins, polyamide resins, polyester resins, and maleic acid resins. Regarding all the resins, there are no particular limitations on their preparation process.

Of these resins, the effect of the present invention can be greatest particularly when polyester resins are used, which have a high negative chargeability. That is, the polyester resins can achieve excellent fixing performance and are suited for color toners, but on the other hand have so strong a negative chargeability that charges tend to become excessive. However, the use of polyester resins under the constitution of the present invention can be free of such difficulties and can bring about an excellent toner.

In particular, the following polyester resin is preferred because of its sharp melt properties, which is a polyester resin obtained by co-condensation polymerization of i) a diol component comprised of a bisphenol derivative or substituted bisphenol represented by the formula:

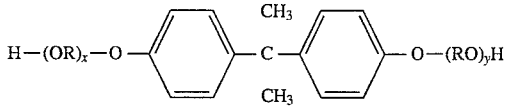

wherein R represents an ethylene group or a propylene group, and x and y each represent an integer of 1 or more, where x+y is 2 to 10 on the average;

and ii) a carboxylic acid component comprising a dibasic or higher basic carboxylic acid or an acid anhydride or lower alkyl ester thereof, as exemplified by fumaric acid, maleic acid, maleic anhydride, phthalic acid, terephthalic acid, trimellitic acid and pyromellitic acid.

In particular, in view of light transmission properties required for overhead projection (OHP) transparency, the binder resin may have an apparent viscosity of from $5\times10^4$ to $5\times10^6$ poises, preferably from $7.5\times10^4$ to $2\times10^6$ poises, and more preferably from $10^5$ to $10^6$ poises, at 90° C., and an apparent viscosity of from $10^4$ to $10^5$ poises, preferably from $10^4$ to $3\times10^5$ poises, and more preferably from $10^4$ to $2\times10^5$ poises, at 100° C. This makes it possible to obtain color OHP with a good light transmittance, and also obtain good results for fixing performance, color mix properties and high-temperature anti-offset properties when used in full-color toners. It is particularly preferred that an absolute value of difference between apparent viscosity $P_1$ at 90° C. and apparent viscosity $P_2$ at 100° C. is within the range of;

$$2\times10^5<|P_1-P_2|<4\times10^6.$$

The colorant used in the present invention may include known dyes and pigments as exemplified by Phthalocyanine Blue, Indanthrene Blue, Peacock Blue Lake, Permanent Red, Lake Red, Rhodamine Lake, Hanza Yellow, Permanent Yellow and Benzidine Yellow, any of which can be used.

The colorant may more specifically include the following dyes and pigments.

Magenta-coloring pigments may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and G.I. Pigment Vat Red 1, 2, 10, 13, 15, 23, 29, 35.

Such pigments may each be used alone. In view of image quality of full-color images, it is more preferable to use a dye and a pigment in combination so that the sharpness can be improved.

Magenta-coloring dyes may include oil-soluble dyes such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, 40; and C.I. Basic Violet 1, 3, 7, 10, 14, 15, 21, 25, 26, 27, 28.

Cyan-coloring pigments may include C.I. Pigment Blue 2, 3, 15, 16, 17; C.I. Vat Blue 6; and C.I. Acid Blue 45 or a copper phthalocyanine pigment having the structure as shown by formula (1) below, having a phthalocyanine skeleton substituted with 1 to 5 phthalimidomethyl group(s).

(1)

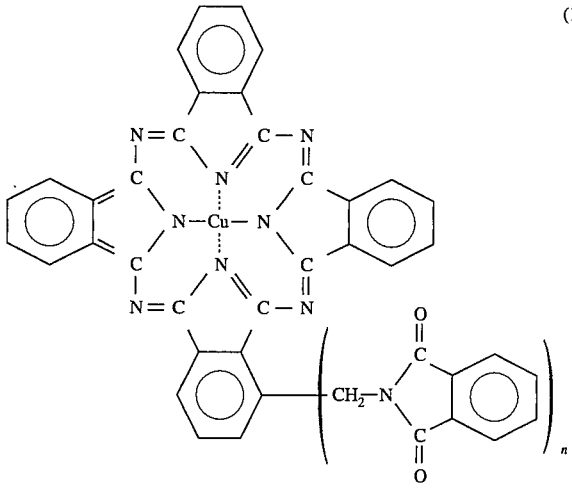

n = 1 to 5

Yellow-coloring pigments may include C.I. Pigment Yellow 1, 2, 3, 4, 5, 6, 7, 10,11, 12, 13, 14, 15, 16, 17, 23, 65, 73, 83; and C.I. Vat Yellow 1, 3, 20.

The colorant may be used in an amount of from 0.1 to 60 parts by weight, and preferably from 0.5 to 50 parts by weight, based on 100 parts by weight of the binder resin. In particular, taking account of a sensitive reflection to light transmission properties of OHP films, the colorant should preferably be used in an amount of not more than 12 parts by weight, and more preferably from 0.5 to 9 parts by weight, based on 100 parts by weight of the binder resin.

In the toner particles according to the present invention, a charge control agent may be mixed so that their charge performance can be stabilized. In that instance, it is preferred to use a Colorless or pale-colored charge control agent that does not affect the color tone of the toner. A negative charge control agent used there may include organic metal complexes as exemplified by a metal complex of alkyl-substituted salicylic acid, e.g., a chromium complex or zinc complex of di-tert-butylsalicylic acid. In the case when the negative charge control agent is mixed in the toner, it should be added in an amount of from 0.1 to 10 parts by weight, and preferably from 0.5 to 8 parts by weight, based on 100 parts by weight of the binder resin.

When positively chargeable toners are produced, Nigrosine, triphenylmethane compounds, Fhodamine dyes, polyvinyl pyridine of the like may be used as a charge control agent showing a positive chargeability. When Color toners are produced, it is desirable to use binder resins in which amino-containing carboxylic acid esters such as dimethylaminomethyl methacrylate showing a positive chargeability are contained as monomers in an amount of from 0.1 to 40 mol %, and preferably from 1 to 30 mol %, or colorless or pale-color positive charge control agents having no influence on the tone of the toner.

The toner of the present invention may be optionally incorporated with additives so long as the properties of the toner are not damaged. Such additives may include, for example, lubricants such as Teflon, zinc stearate and polyvinylidene fluoride, and fixing aids as exemplified by a low-molecular weight polyethylene and a low-molecular weight polypropylene.

In preparing the toner of the present invention, it is possible to apply a method in which component materials are well kneaded by means of a heat-kneading machine such as a heat roll, a kneader or an extruder, thereafter the kneaded product is pulverized by a mechanical means, and then the pulverized powder is classified to give a toner; a method in which materials such as colorants are dispersed in a binder resin solution, followed by spray drying to give a toner; and a method of preparing a toner by polymerization, comprising mixing given materials with binder resin constituent polymerizable monomers, and subjecting an emulsion suspension of the resulting mixture to polymerization.

In the two-component type developer of the present invention, the carrier having the particle size distribution previously specified, in particular, as included therein, a carrier in which the aforesaid specific surface area S1 as measured by an air-permeability method is within the range of;

$$350 \leqq S_1 \leqq 600 \text{ cm}^2/\text{g}$$

and the carrier particles with a size smaller than 22 μm are in a content of from 1% to 20%, carrier particles with a size of from 22 μm to less than 62 μm are in a content of not less than 75% and the carrier particles with a size of 62 μm or larger are in a content of from 2% to 15%, may be used in combination with a toner having specific surface area and particle size distribution as specified below. In such an instance, the specific surface area of the carrier and the specific surface area of the toner have a preferable relationship and hence the toner can be uniformly charged. Thus, high image density, highlight reproduction and fine-line reproduction can be superior, and also toner scatter and fog can be better prevented.

More specifically, what is preferable as the toner used in combination with the carrier as specified above is a toner that satisfies the following condition:

$$1.0 \leqq S_B \leqq 1.8 \text{ (m}^2/\text{g)},$$

$$1.20 \leqq S_B/S_A \leqq 1.70$$

wherein $S_A$ is a specific surface area directly calculated from a weight average particle diameter of toner calculated from volume average distribution data of a Coulter counter and $S_B$ is a specific surface area calculated from number average distribution data of a Coulter counter; and contains toner particles with a particle diameter of 4.0 μm or smaller in an amount of from 10% to 70% by number.

The toner satisfying the above conditions of specific surface area $S_B$ and specific surface area ratio $S_B/S_A$ enables faithful reproduction of the latent images formed on a photosensitive member and also enables good reproduction of minute dot latent images such as halftone dots and digital images, so that it can provide images with superior highlight reproduction and resolution.

It has been also found that the extent of particle size distribution that is expressed by $S_B/S_A$ has indeed a great influence on the deterioration of images during running, the toner scatter and the fog and its proper control makes it possible to maintain a high image quality over a long period of running.

The reason why such effect can be obtained in the toner of the present invention is not necessarily clear, and is presumed as follows:

At the outset, a first feature in the toner of the present invention is that the specific surface area $S_B$ of toner that is calculated from number average distribution of toner particles as measured using a Coulter counter is within the range of;

$$1.0 \leqq S_B \leqq 1.8 \text{ (m}^2/\text{g)}.$$

In order to achieve a higher image quality, the present inventors have hitherto attempted to a little finely shift the average particle diameter of toners. They, however, have noted that, taking as an example only the triboelectric charging between a carrier and a toner, the chances of contact with carrier particle surfaces are important for not only the rise of charge of the toner but also achieving its stable chargeability and that the specific surface area of the toner is indeed an important factor for truely maintaining and controlling image quality, and made extensive studies. As a result, they have discovered that good results can be obtained when the $S_B$ is within the above range.

Namely, an instance where the $S_B$ is smaller than 1.0 $m^2/g$ means that a toner is short of the fine particle toner that can contribute the achievement of a higher image quality. In such an instance, the toner certainly has the advantages that a high image density can be readily obtained and also the toner can have a good fluidity, but is hard to faithfully adhere onto fine latent images, resulting in a poor highlight reproduction and also no satisfactory resolution. Such a toner also tends to cause excessive development, i.e., over-application of toner, and cause an increase in toner consumption.

On the other hand, an instance where the $S_B$ is larger than 1.8 $m^2/g$ means that the charge quantity per unit weight of toner becomes extremely high, where image density becomes insufficient, in particular, becomes insufficient in an environment of low temperature and low humidity. Such a toner is unsuited for its use in graphic images or the like having a high proportion of image area. Moreover, such a toner can not achieve a smooth charging by its contact with carrier, so that a toner not well chargeable may increase and the scatter on non-image areas, i.e., fog may become conspicuous. To cope with such a problem, one may contemplate to make particle diameter of a carrier greatly smaller in order to gain the specific surface area of the carrier. However, self-agglomeration of toner tends to occur so long as the $S_B$ is larger than 1.8 $m^2/g$, and its uniform blending with carrier can not be achieved in a short time. Thus, a fogging toner tends to be produced after all when toner is continually supplied to carry out running.

Hence, in the present invention, the toner may preferably have a specific surface area $S_B$ of not less than 1.0 $m^2/g$ to not more than 1.8 $m^2/g$, and more preferably not less than 1.05 $m^2/g$ to not more than 1.7 $m^2/g$.

A second feature of the toner of the present invention is the discovery that the $S_B/S_A$, wherein $S_A$ is a specific surface area which is directly calculated from a weight average particle diameter (usually indicated as $D_4$) calculated from volume average distribution data of a Coulter counter, represents an extent of the particle size distribution of toner, which has a great influence on the deterioration of images during running, the toner scatter and the fog and its proper control is indeed a technique for providing the key to maintenance of a high image quality over a long period of running.

The present inventors made studies on the state of particle size distribution and the developing performance, in the course of which they have found a condition in which a particle size distribution most suited for achieving the object can be present when the $S_B/S_A$ is $1.20 \leqq S_B/S_A \leqq 1.70$.

Namely, an instance where the $S_B/S_A$ is smaller than 1.20 corresponds to a system in which fine powder has been cut to excess when the particle size distribution is adjusted by air classification commonly used. In such an instance, the toner certainly can have a good fluidity and achieve a high image density with ease. There are additional advantages that the toner may cause less variations of particle size as a result of running and can be favorable for long-term running. However, since the toner is short of the fine powder that is an essential component for highlight reproduction as previously stated, it may have a poor gradation after all, making it impossible to satisfactorily achieve the object of the present invention. In addition, the toner can not avoid its cost increase after all, and can not be a highly cost-advantageous toner.

On the other hand, an instance where the $S_B/S_A$ is larger than 1.70 results in a broad particle size distribution, and corresponds to a system in which, in particular, the fine-powder side toner is in excess. Under such particle size distribution, images with much fog as a whole may be formed and the toner dan not avoid its decrease in fluidity because of an increase in the quantity of fine powder, so that the toner can not be faithfully laid onto fine latent images on a photosensitive drum.

Hence, in the present invention, the $S_B/S_A$ may preferably be not less than 1.2 to not more than 1.7, and more preferably not less than 1.20 to not more than 1.60. The toner satisfying such particle size distribution can achieve superior fluidity and gradation as well as long-term running stability.

On the basis of what has been described above, the toner of the present invention may preferably contain toner particles with a particle diameter of 4 μm or smaller in an amount of from 10% to 70% by number, and preferably from 15% to 60% by number, of the whole particle number. An instance where the toner particles with a particle diameter of 4 μm or smaller are in an amount of less than 10% by number means the the toner is short of the fine toner particles serving as an essential component for achieving a high image quality, where, in particular, effective toner particle components may decrease as the toner is continuously consumed as a result of copying or printing-out continuously carried out, so that the particle size distribution of toner as shown in the present invention may become ill-balanced tend to cause a gradual lowering of image quality.

The carrier used in the above two-component type developer, having the specific surface area and particle size distribution as specified above, will be further describe below.

In the carrier used in the present invention, the specific surface area $S_1$ as measured by an air-permeability method may preferably be $350 \leqq S1 \leqq 600$ $cm^2g$, and more preferably $380 \leqq S_1 \leqq 550$ $cm^2/g$, and the carrier particles with a size smaller than 22 μm should be in a content of from 1% to 20%, preferably from 2% to 15%, and more preferably from 4% to 12%, of the whole carrier.

If the quantity of fine powder present in the carrier increase to make its specific surface area $S_1$ more than 600 $cm^2/g$, carrier adhesion tends to occur even when used in combination with the toner having the specific surface area as specified above, and carrier adhesion also tends to seriously occur also when the carrier particles with a size smaller than 22 μm are in a content more than 20%, so that the movement of developer in a developing assembly also may become not smooth to make it hard to achieve smooth charging between the toner and the carrier. If the carrier particles with a size smaller than 22 μm are in a content less than 1%, the magnetic brusk on a sleeve may become rough to cause toner scatter and fog. As coarse powder, the content of carrier particles with a size of 62 μm or larger closely correlates with the sharpness of images. Hence, the carrier must contain 2 to 15%, and preferably 4 to 13%, of such carrier particles. If their content is more than 15%, the carrier may lower its own transport performance of the toner to cause an increase in the scatter of toner on non-image areas, resulting in a lowering of resolution of images and a lowering of highlight reproduction. If the quantity of coarse powder present in the carrier proportionally increase to make its specific surface area $S_1$ less than 350 $cm^2/g$, the toner-carrying performance of the carrier may become poor especially when used in combination with the fine-particle toner as used in the present invention, so that, in particular, the toner scatter may become unavoidable during running. An attempt to decrease toner concentration as a countermeasure for it may make density insufficiency and coarse images conspicuous, and can not fundamentally solve the problem. Hence, when the toner with a high resolution as in the present invention is used, the specific surface area $S_1$ may preferably be $350 \leqq S_1 600 \leqq$ $cm^2/g$.

As for the coarse powder, if the carrier particles with a size larger than 62 μm are in a content less than 1%, the developer may have a poor fluidity to cause a local or uneven distribution of the developer inside the developing assembly, making it difficult to obtain stable images.

In the carrier of the present invention, carrier particles with a size of from 22 μm to 62 μm may preferably be in a content not less than 75%, and more preferably not less than 78%, of the whole carrier. An instance where the carrier particles with a size falling in this range are in a content less than 75% means that the carrier has a broad particle size distribution, which may make the rise of charging uneven when the toner is supplied, so that the toner may have a broad triboelectric distribution, which may cause fog and toner scatter. The carrier having such a broad particle size distribution may also make it difficult to provide a uniform magnetic brush on the sleeve, making it hard to carry out high-density development.

The image forming method of the present invention comprises developing in a developing zone defined by a latent image bearing member and a developer carrying member provided opposingly thereto, a latent image beared on the latent image bearing member, using a toner of a two-component type developer carried on the developer carrying member.

This two-component type developer comprises the carrier and toner of the present invention, having the particle size distribution as previously specified.

The image forming method of the present invention may also preferably comprise forming in the developing zone a developing electric field between the latent image bearing member and the developer carrying member by applying to the developer carrying member a first voltage for directing the toner from the latent image bearing member toward the developer carrying member, a second voltage for directing the toner from the developer carrying member toward the latent image bearing member and a third voltage intermediate between the first voltage and the second voltage, to develop a latent image beared on the latent image bearing member, using the toner of the developer carried on the developer carrying member.

In the foregoing, a time ($T_1$) for which the first voltage for directing the toner from the latent image bearing member toward the developer carrying member and the second voltage for directing the toner from the developer carrying member toward the latent image bearing member are applied to the developer Carrying member may be made shorter than a time for which the third voltage intermediate between the first voltage and the second voltage is applied to the developer carrying member. This is particularly preferred in order to rearrange the toner and reproduce images faithfully to latent images on the latent image bearing member.

Stated specifically, the image forming method may comprise forming in the developing zone, at least once between the latent image bearing member and the developer carrying member, an electric field in which the toner is directed from the latent image bearing member toward the developer carrying member and an electric field in which the toner is directed from the developer carrying member toward the latent image bearing member, and thereafter forming for a given time an electric field in which the toner is directed from the developer carrying member toward the latent image bearing member in an image area of the latent image bearing member and an electric field in which the toner is directed from the latent image bearing member toward the developer carrying member in a non-image area of the latent image bearing member, to develop a latent image beared on the latent image bearing member, using the toner of the developer carried on the developer carrying member, where a total time ($T_1$) for forming the electric field in which the toner is directed from the latent image bearing member toward the developer carrying member and the electric field in which the toner is directed from the developer carrying member toward the latent image bearing member may preferably be made shorter than a time for forming the electric field in which the toner is directed from the developer carrying member toward the latent image bearing member in an image area of the latent image bearing member and the electric field in which the toner is directed from the latent image bearing member toward the developer carrying member in a non-image area of the latent image bearing member.

The present inventors have discovered that a higher image quality with a high image density and superior highlight reproduction and fine-line reproduction can be achieved without causing any carrier adhesion, when development is carried out in the presence of a developing electric field where alternation is periodically made off in a developing process in which development is carried out while forming an alternating electric field, using the carrier for electrophotography of the present invention having the specific particle size distribution.

The carrier for electrophotography of the present invention has the specific average particle diameter and particle size distribution as previously described, and hence has achieved an improvement in the rise of triboelectric charging with the toner. In the meantime, because of a very large quantity of the fine powder present therein, one may concern oneself about the carrier adhesion to the latent image bearing member during development. However, its use in combination of specific developing electric fields by no means causes the carrier adhesion. The reason therefor is still unclear, and is presumed as follows:

In conventional continuous sinusoidal or rectangular waves, when an electric field intensity is made higher in an attempt to achieve a higher image quality and density, toner and carrier join to reciprocate between a latent image bearing member and a developer carrying member, so that the carrier strongly rubs against the latent image bearing member to cause the carrier adhesion. This more remarkably tends to occur with an increase in the fine powder carrier.

However, in the present invention, the application of the specific developing electric field as described above causes the toner or the carrier to reciprocate between the developer carrying member and the latent image bearing member in an incomplete reciprocation under one pulse. Hence, after that, in the case when a potential difference $V_{cont}$ between the surface potential of the latent image bearing member and the potential of a direct current component of a developing bias is $V_{cont}<0$, the direct current component acts in the manner that it causes the carrier to fly from the developer carrying member. However, the carrier adhesion can be prevented by controlling magnetic properties of the carrier and magnetic flux density in the developing zone of a magnet roller. In the case of $V_{cont}>0$, the force of a magnetic field and the direct current component act in the manner that they attract the carrier to the side of the developer carrying member, where no carrier adhesion may occur.

In order to make the present invention much more effective, the carrier may preferably be made to have an apparent density of from 1.8 to 3.2 g/cm$^3$. If it has an apparent density lower than the above lower limit, the carrier adhesion may tend to occur. On the other hand, if it has an apparent density higher than the above upper limit, not only the toner scatter may tend to occur but also the deterioration of images may be accelerated.

Figure 6:
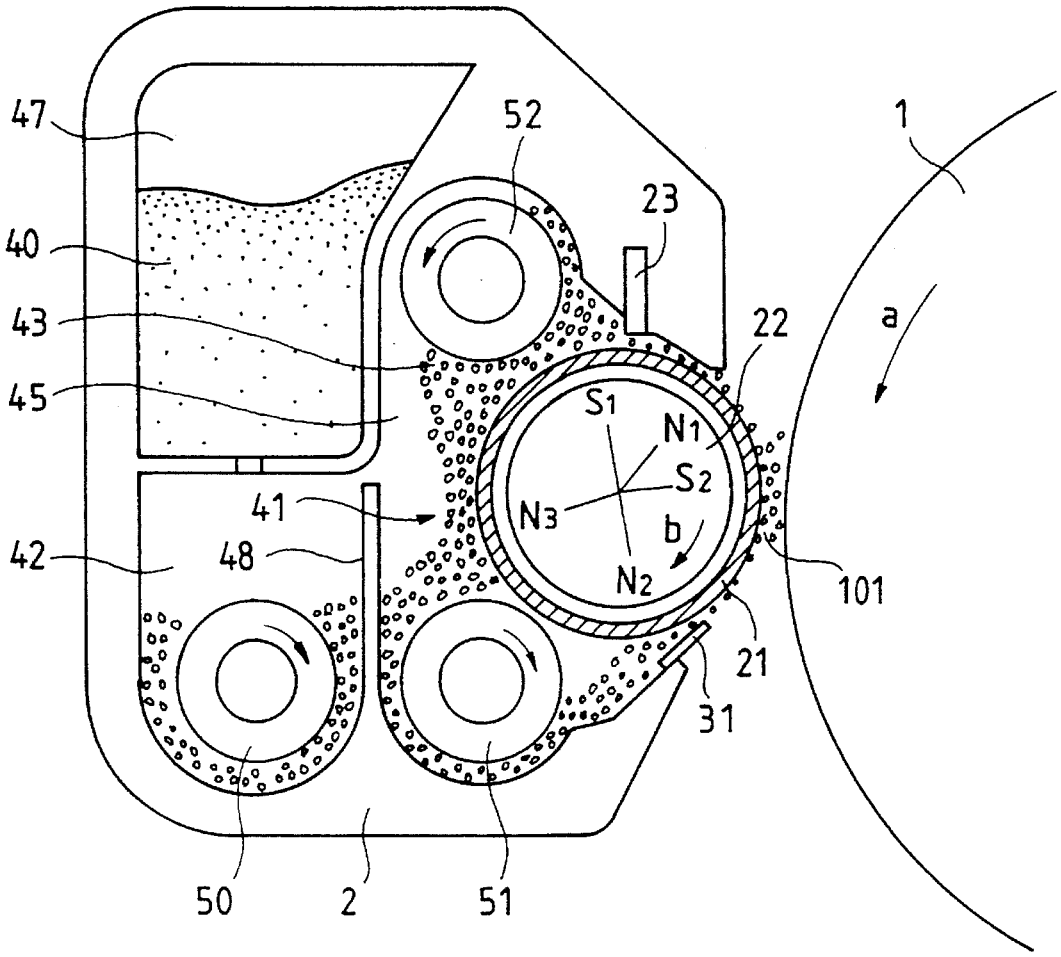
FIG. 6 illustrates a preferred developing system that can be used in the image forming method of the present invention.

A developing device or system usable in the image forming method of the present invention will be described below with reference to FIG. 6.

The developing system comprises a developing container 2 receiving a developing chamber 45 having therein a non-magnetic developing sleeve 21 serving as a developer carrying member, which is provided opposingly to an electrostatic latent image bearing member 1 rotatable in the direction of an arrow a. In this developing sleeve 21, a magnetic roller 22 as a magnetic field generating means is left to stand stationary, and the magnetic roller 22 is magnetized to have magnetic poles in the order of $S_1$, $N_1$, $S_2$, $N_2$ and $N_3$ from substantially the top position thereof in the rotational direction of an arrow b.

The developing chamber 45 holds therein a two-component type developer 41 comprising a blend of a toner 40 with a magnetic carrier 43.

This developer 41 is sent to the inside of an agitator chamber 42 of the developing container 2 through one opening (not shown) made in a partition wall 48 whose Upper end is open at one end of the developing chamber 45, where the toner 40 having been fed into the agitator chamber 42 is supplied from a toner chamber 47 and is transported to the other end of the agitator chamber 42 while being blended by a first developer agitating-transporting means 50. The developer 41 having been transported to the other end of the agitator chamber 42 is sent to the inside of the developing chamber 45 through the Other opening (not shown) made in the partition wall 48, and then fed onto the developing sleeve 21 while being agitated and transported by a second developer agitating-transporting means 51 in the developing chamber 45 and a third developer agitating-transporting means 52 for transporting the developer at the upper part in the developing chamber 45 in the direction reverse to the direction in which the developer is transported by the transporting means 51.

The developer 41 fed onto the developing sleeve 21 is magnetically bound thereto by the action of a magnetic force of the magnetic roller 22, and thus carried on the developing sleeve 21. Then the developer is, while being formed into a thin layer of the developer 41 on the developing sleeve 21 by the regulation of a developer regulating blade 23 provided substantially above the top of the developing sleeve 21, transported to a developing zone 101 opposing to the latent image bearing member 1, as the developing sleeve 21 is rotated in the direction of the arrow b, where the developer is used for the development of the latent image formed on the latent image bearing member 1. Remaining developer 41 not consumed for the development is returned to the developing container 2 as the developing sleeve 21 is rotated.

In the developing container 2, the remaining developer 41 not consumed for the development, magnetically bound onto the developing sleeve 21, is so designed that it is taken off by a repulsive magnetic field formed across $N_2$ and $N_3$ having the same polarity. In order to prevent toner scatter from occurring when the developer 41 rises in ears along the line of magnetic force by the action of the magnetic pole $N_2$, an elastic seal member 31 is provided stationarily at the lower part of the developing container 2 in such a manner that its one end comes in touch with the developer 41.

In the image forming method making use of the carrier for electrophotography of the present invention, the magnetic properties Of the carrier are influenced by the magnet roller built in the developing sleeve, and greatly influences the developing performance and transport performance of the developer.

In the present invention, of the developing sleeve (the developer carrying member) and its built-in magnet roller, the latter magnet roller, for example, is set stationary and the former developing sleeve is set rotary alone, where a two-component type developer comprised of a carrier (comprising magnetic particles) and an insulating color toner is circulatively transported onto the developing sleeve so that the electrostatic latent image beared on the surface of the electrostatic latent image bearing member is developed by the two-component type developer. In the instance where the carrier having the specific particle size distribution as previously described is used in combination in this developing system, color copying can enjoy good image uniformity and gradation reproduction especially when (1) the magnetic roller is comprised of five poles having a repulsion pole, (2) the magnetic flux density in the developing zone is set at 500 to 1,200 gauss and (3) the carrier is made to have a saturation magnetization of 90 to 35 emu/g. Thus, such an embodiment is preferred.

The present inventors also made extensive studies on image density, highlight reproduction and fine-line reproduction in a color image forming method. As a result, they have discovered that a higher image quality with a high image density and superior highlight reproduction and fine-line reproduction can be achieved when the toner having the specific particle size distribution as previously described is used in the image forming method making use of the developing process in which the specific developing electric field as previously described.

More specifically, the toner used in such an image forming method of the present invention contains at least colorant-containing resin particles and an external additive; has a weight average particle diameter of from 3 μm to 7 μm; and contains more than 40% by number of toner particles with a particle diameter of 5.04 μm or smaller, from 10% to 70% by number of toner particles with a particle diameter of 4 μm or smaller, from 2% to 20% by volume of toner particles with a particle diameter of 8 μm or larger, and not more than 6% by volume of toner particles with a particle diameter of 10.08 μm or larger.

The toner having the above particle size distribution enables faithful reproduction of the latent images formed on a photosensitive member and also enables good reproduction of minute dot latent images such as halftone dots and digital images, so that it can particularly provide images with superior highlight gradation and resolution. Moreover, such a toner can maintain a high image quality even when copying or printing-out is continued, and also can promise good development carried out at a smaller toner consumption than conventional non-magnetic toners even in the case of images with a high density, bringing about not only economical advantages but also advantages for making the bodies of copying machines or printers smaller in size.

In conventional continuous sunisoidal waves or rectangular waves, however, even if the toner can achieve a good latent image reproduction, latent images having a small development contrast, such as highlight latent images, have originally no sufficient electric field intensity. Hence, under continuous pulses, the proportion in which the toner does not reach the latent image bearing member becomes larger. Namely, in a bias applied under such conditions, the toner moves vibrationally in such a manner that it does not reach the latent image bearing member from the developer carrying member.

However, in the present invention, the formation of a specific developing electric field as described later makes it possible to obtain good highlight images free of coarse images. That is, under one pulse, the toner similarly reciprocates between the developer carrying member and the latent image bearing member in an incomplete reciprocation, but, after that, in the case when a potential difference $V_{cont}$ between the surface potential of the latent image bearing member and the potential of a direct current component of a developing bias is $V_{cont}<0$, the direct current component acts in the manner that it attracts the toner to the side of the developer carrying member, so that the toner is one-sided on the side of the developer carrying member. In the case of $V_{cont}>0$, on the other hand, the direct current component acts in accordance with a latent image potential, in the manner that it attracts the toner to the side of the latent image bearing member, so that the toner in a quantity corresponding to the latent image potential is one-sided on the side of the latent image bearing member. When development is carried out under such conditions, the toner having reached the surface of the latent image bearing member repeats vibrations there until it concentrates in latent image areas. Hence, the shapes of dots are made uniform to make it possible to obtain good images free of uneveness.

As described above, the conversion of latent images into visible images in a development bias applied under the above conditions causes no blanks of dots even in the case of highlight latent images. Moreover, the toner repeating vibrations on the latent image bearing member causes itself to concentrate in the latent image areas, so that every dot can be faithfully reproduced and, in the two-component type developer, halftone images free of any irregularities ascribable to the state of contact of the magnetic brush can be outputted.

The image forming method in which such a specific developing electric field is formed may preferably comprise forming in the developing zone a developing electric field between the latent image bearing member and the developer carrying member by applying to the developer carrying member a first voltage for directing the toner from the latent image bearing member toward the developer carrying member, a second voltage for directing the toner from the developer carrying member toward the latent image bearing member and a third voltage intermediate between the first voltage and the second voltage, to develop a latent image beared on the latent image bearing member, using the toner of the developer carried on the developer carrying member.

In the foregoing, a time ($T_1$) for which the first voltage for directing the toner from the latent image bearing member toward the developer carrying member and the second voltage for directing the toner from the developer carrying member toward the latent image bearing member are applied to the developer carrying member may preferably be made shorter than a time for which the third voltage intermediate between the first voltage and the second voltage is applied to the developer carrying member.

Stated specifically, the image forming method may comprise forming in the developing zone, at least once between the latent image bearing member and the developer carrying member, an electric field in which the toner is directed from the latent image bearing member toward the developer carrying member and an electric field in which the toner is directed from the developer carrying member toward the latent image bearing member, and thereafter forming for a given time an electric field in which the toner is directed from the developer carrying member toward the latent image bearing member in an image area of the latent image bearing member and an electric field in which the toner is directed from the latent image bearing member toward the developer carrying member in a non-image area of the latent image bearing member, to develop a latent image beared on the latent image bearing member, using the toner of the developer carried on the developer carrying member, where a total time ($T_1$) for forming the electric field in which the toner is directed from the latent image bearing member toward the developer carrying member and the electric field in which the toner is directed from the developer carrying member toward the latent image bearing member may be made shorter than a time for forming the electric field in which the toner is directed from the developer carrying member toward the latent image bearing member in an image area of the latent image bearing member and the electric field in which the toner is directed from the latent image bearing member toward the developer carrying member in a non-image area of the latent image bearing member.

Measuring methods used in the present invention will be described below.

(1) Measurement of magnetic properties of carrier:

A BHU-60 type magnetization measuring device (manufactured by Riken Sokutei Co.) is used as an apparatus for measuring magnetic properties of the carrier to obtain the results.

A sample for measurement (about 1.0 g) is weighted and packed in a cell of 7 mm diameter and 10 mm high, which is then set in the above apparatus. Measurement is made while gradually increasing an applied magnetic field to be changed to 3,000 oersted at maximum. Subsequently, the applied magnetic field is decreased, and finally a hysteresis curve of the sample is obtained on a recording paper. Saturation magnetization, residual magnetization and coercive force are determined therefrom.

(2) Measurement of particle size of carrier:

An SRA type microtrack particle size analyzer (manufactured by Nikkiso K.K.) is used as an apparatus for measuring particle size distribution of the carrier. Measurement range is set at from 0.7 to 125 μm, and the 50% average particle diameter ($D_{50}$) and particle size distribution are determined.

(3) Measurement of specific surface area of carrier:

Specific surface area of the carrier is measured according to the following procedure.

Using a powder specific surface area measuring device manufactured by Shimadzu Corporation (SS-100 type) as a measuring apparatus, the measurement is made according to the following procedure.

(A) A sieve plate is put in a sample cylinder made of plastic, and then a sheet of filter paper is put down on the plate, on which a sample is put by ⅓ of the sample cylinder.

(B) The sample cylinder is set on a tapping stand of a powder tester, followed by tapping for 1 minute.

(C) In the sample cylinder thus tapped, the sample is put by ⅔ of the sample cylinder.

(D) The same operation as (B) is repeated.

(E) A sub-cylinder made of plastic is inserted to the top of the sample cylinder, and the sample is heaped from the top thereof.

(F) The same operation as (B) is repeated.

(G) From the sample cylinder thus tapped, the sub-cylinder is pull out, and the remaining excess sample is cut with a spatula.

(H) A specific surface area measuring tube is filled with water up to the mark S.

(I) The sample cylinder is connected to the measuring tube. (After packed with the sample, grease is applied to the fitting surfaces.)

(J) A cock of an outlet at the lower part is opened, and a stopwatch is started at the time the water surface in the measuring tube passes the mark O. (The water flowed out at the lower part is received in a beaker.)

(K) Time for which the water surface drops to the mark 20 (unit: cc) is measured.

(L) The sample cylinder is detached to measure the weight of the sample.

(M) The specific surface area is calculated according to the following expression.

$$S_1 = \frac{14}{\rho}\sqrt{\frac{\Delta P \cdot A \cdot t}{\eta \cdot L \cdot Q} \cdot \frac{e^3}{(1-e)^2}}$$

$$e = 1 - W/\rho A \cdot L$$

wherein;

$S_1$ is a specific surface area of powder (cm2/g);

e is a void of the sample-packed layer;

ρ is a density of powder (g/cm$^3$);

η is a coefficient of viscosity of the fluid (g/cm.sec);

L is a thickness of the sample layer (cm);

Q is a quantity of the fluid having permeated the sample layer (cc);

t is a time taken for Q cc of fluid (air) to permeate the sample layer (sec);

ΔP is a pressure difference between both ends of the sample layer (g/cm$^2$);

A is a sectional area of the sample layer (cm$^2$); and

W is a weight of the sample (g).

(4) Measurement of particle size of toner:

The particle size distribution can be measured by various methods. In the present invention, it is measured using a Coulter counter.

A Coulter counter Type TA-II (manufactured by Coulter Electronics, Inc.) is used as a measuring device. An interface (manufactured by Nikkaki k.k.) that outputs number distribution and volume distribution and a personal computer CX-1 (manufactured by Canon Inc.) are connected. As an electrolytic solution, an aqueous 1% NaCl solution is prepared using first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution of particles of 2 μm to 40 μm are calculated by measuring the volume and number of toner particles by means of the above Coulter counter Type TA-II, using an aperture of 100 μm as its aperture. Then the values according to the present invention are determined, which are the weight-based, weight average particle diameter D4 determined from the volume distribution (where the middle value of each channel is used as the representative value for each channel), the weight-based, coarse-powder content (16.0 μm or larger) determined from the volume distribution, and the number-based, fine-powder particle number (5.04 μm or smaller and 4.00 μm or smaller).

(5) Measurement of specific surface area of toner:

An electrolytic solution in which a sample has been suspended is subjected to dispersion for about 1 minute to about 3 minutes in an ultrasonic dispersion machine. Volume distribution and number distribution of particles of 2.00 μm to 50.80 μm are measured by means or the Coulter counter Type TA-II, using an aperture of 100 μm as its aperture.

To calculate the specific surface area $S_B$ of the toner, particles with diameters of 2.00 μm to 50.80 μm are divided into 14 channels, and number distribution for each channel is determined. From a representative value of each channel and specific gravity of the toner, specific surface area of toner particles approximated to spheres are determined, and the specific surface area of the toner is determined from number percentage for each channel.

In the present invention, the representative value for each channel is regarded as an exponential value of a two-point average of logarithms taken on upper and lower limit values in each channel.

For example, a representative value in the range of from 3.17 μm to 4.00 μm is as follows:

$$\exp\left(\frac{\ln 3.17 + \ln 4.00}{2}\right) = 3.56\ \mu m$$

Representative values are similarly determined also in respect of other 13 channels, and the specific surface area of the toner is determined for each channel, which is calculated from the number distribution described above, to finally determine the specific surface area $S_B$ of the toner.

When the particles with diameters of 2.00 μm to 50.80 μm are divided into 14 channels, they are divided in the following way. First channel: 2.00 to 2.52 μm; second channel: 2.52 to 3.17 μm; and the rest: 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, 32.00 to 40.30 μm, and 40.30 to 50.80 μm.

Regarding the specific surface area $S_A$, it is calculated as specific surface area of toner particles approximated to spheres, which is directly calculated from weight average particle diameter of toner calculated from volume average distribution, and specific gravity thereof.

(6) Measurement of hydrophobicity:

Methanol titration is an experimental means for ascertaining the hydrophobicity of fine titanium oxide particles whose surfaces have been made hydrophobic.

"Methanol titration" for evaluating the hydrophobicity of treated fine titanium oxide particles is carried out in the following way: 0.2 g of fine titanium oxide particles to be tested are added to 50 ml of water contained in an Erlenmeyer flask with a volume of 250 ml. Methanol is dropwise added from a buret until the whole fine titanium oxide particles have been swelled. Here, the solution inside the flask is continually stirred by a magnetic stirrer. The end point can be observed upon suspension of the whole fine titanium oxide particles in the solution. The hydrophobicity is expressed as a percentage of the methanol present in the liquid mixture of methanol and water when the reaction has reached the end point.

(7) Measurement of transmittance:

| | |
|---|---|
| 1. Sample | 0.10 g |
| Alkyd resin | 13.20 g * 1 |
| Melamine resin | 3.30 g * 2 |
| Thinner | 3.50 g * 3 |
| Glass media | 50.00 g |

* 1 BECKOZOLE 1323-60-EL, available from Dainippon Ink & Chemicals, Incorporated
* 2 SUPER BECKAMINE J-820-60, ditto
* 3 AMILUCK THINNER, available from Kansai Paint Co., Ltd.

Materials with the above composition are collected in a 150 cc mayonnaise bottle, and dispersion is carried out for 1 hour using a paint conditioner manufactured by Red Devil Co.

2. After the dispersion has been completed, the dispersed product is coated on a PET film by means of a 2 mil. doctor blade.
3. The coating formed in the step 2. is heated at 120° C. for 10 minutes to carry out baking.
4. The sheet obtained in the step 3. is set on U-BEST 50, manufacture by Nihon Bunkou Co., to measure its transmittance in the range of 320 to 800 nm and make comparison.

In the carrier of the present invention, the two-component type developer making use of the carrier and the image forming method making use of the two-component type developer, the carrier has the specific particle size distribution as previously described, and hence makes it possible to obtain high-quality images with a high image quality, a high minuteness and a high image density over a long period of running, also makes it hard to cause a decrease in image density and blurred images even when copies of color originals with a large image area are continuously taken, can contribute quick rise of triboelectric charging between toner and carrier, and may give less environmental dependence of the triboelectric charging.

Moreover, in the image forming method of the present invention, images are formed using the toner having the specific particle size distribution and in the presence of the specific developing electric field, as previously described. Hence, developing performances that may be affected with difficulty by environmental conditions such as temperature and humidity and are always stable can be achieved and also high-quality (color) images with a high image density and superior highlight reproduction and fineline reproduction can be obtained.

EXAMPLES

The present invention will be described below in greater detail by giving Examples. In the following Examples, "part(s)" refers to "part(s) by weight" in all occurrences unless particularly noted.

Preparation of Carrier A

After 15 parts of CuO, 15 parts of ZnO and 70 parts of $Fe_2O_3$ were respectively formed into fine particles, these were mixed with addition of water to carry out granulation, followed by baking at 1,200° C. and then adjustment of particle size. Thus, ferrite carrier core material A was obtained. The core material A thus obtained was coated with a solution prepared by dissolving 10 parts of methyl methacrylate having a weight average molecular weight of 32,000 in 90 parts of toluene, using a coater (SPIRA COATER, manufactured by Okada Seiko Co.) in a resin coating weight of 1.0% by weight. Thus, carrier A having the particle size distribution as shown in Table 1 was obtained.

Various properties of Carrier A thus obtained are also shown in Table 1.

Preparation of Carriers B to H

The preparation of Carrier A was repeated to obtain Carriers B to H, respectively, except that the particle size distribution and the coating resin material were respectively changed as shown in Table 1.

Various properties of Carriers B to H thus obtained are shown in Table 1.

Example 1

| | |
|---|---|
| Polyester resin obtained by condensation of propoxylated bisphenol and fumaric acid | 100 parts |
| Phthalocyanine pigment | 4 parts |
| Chromium complex of di-tert-butylsalicylic acid | 4 parts |

The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The resulting finely pulverized product was classified by means of a multi-division classifier to select particle size in the range of 2 to 8 μm so that the particle size distribution of the present invention was brought about. Thus, colorantcontaining resin particles were obtained.

To the resin particles thus obtained, 1.5% by weight of titanium oxide having a hydrophobicity of 70% and an average particle diameter of 0.05 μm, which was obtained by mixing hydrophilic anatase type fine titanium oxide particles (particle diameter: 0.05 μm; BET specific surface area: 120 $m^2/g$) in an aqueous system with stirring during which $n\text{-}C_4H_9Si(OCH_3)_3$ was added and mixed while dispersing and hydrolyzing it in the aqueous system, so as to be in an amount of 20% by weight as solid content based on the fine titanium oxide particles and so as not to cause coalescence of particles, was added and blended using a Henschel mixer to obtain a cyan toner with an average particle diameter of 6 μm.

Based on 7 parts of the above cyan toner, Carrier A shown in Table 1 was blended in an amount making 100 parts in total weight, to obtain a developer. This Carrier A was a coated ferrite carrier whose particle surfaces had been coated with about 1% by weight of methyl methacrylate.

Using the developer thus obtained and using a commercially available color copying machine manufactured by Canon Inc. (CLC-500; comprising a developing sleeve with a built-in magnet roller comprised of five poles having a development main pole of 960 gauss), a running test was made in an environment of 23° C. and 60% RH.

Development was carried out under conditions set to be $V_{cont}$=400 V and $V_{back}$=−130 V.

As a result, good images with an image density of 1.4 to 1.5 were obtained, achieving a superior highlight reproduction and an image reproduction faithful to an original chart even after running on 10,000 sheets, During continuous copying, images were also obtained without causing any carrier adhesion and density variation, and the developer concentration was well and stably controllable.

Images were also reproduced in environments of temperature/humidity of 23° C./5% RH and 30° C./80% RH, respectively. As a result, as shown in Table 1, good results were obtained.

Example 2

Using a developer prepared in the same manner as in Example 1 except that Carrier B shown in Table 1 was used as the carrier and the toner was blended in a concentration of 9%, images were reproduced similarly. AS a result, as shown in Table 1, good results were obtained.

Development was carried out under conditions set to be $V_{cont}$=300 V and $V_{back}$=−130 V.

Example 3 to 5

Using developers prepared in the same manner as in Example 1 except that Carriers C to E shown in Table 1 were respectively used as the carrier, images were reproduced similarly. As a result, as shown in Table 1, good results were obtained.

Comparative Example 1

Using a developer prepared in the same manner as in Example 1 except that Carrier F shown in Table 1 was used as the carrier, images were reproduced similarly. As a result, as shown in Table 1, image quality was a little lower than that in Example 1 and, in particular, fog became conspicuous. This was presumably because the particle surfaces of the carrier became so smooth that the transport performance of the toner became lower.

Comparative Example 2

Using a developer prepared in the same manner as in Example 1 except that Carrier G shown in Table 1 was used as the carrier, images were reproduced similarly. As a result, as shown in Table 1, carrier adhesion seriously occurred. This was presumably because the particle surfaces of the carrier were too uneven to enable stable coating.

Comparative Example 3

Using a developer prepared in the same manner as in Example 1 except that Carrier H shown in Table 1 was used as the carrier, images were reproduced similarly. As a result, as shown in Table 1, image quality was a little lower than that in Example 1. This was presumably because the carrier had so large particle diameter that the charge performance of the toner became a little lower.

TABLE 1

| | Example | | | | | Comparative Example | | |
|---|---|---|---|---|---|---|---|---|
| | 1 | 2 | 3 | 4 | 5 | 1 | 2 | 3 |
| Carrier: | A | B | C | D | E | F | G | H |

TABLE 1-continued

| | Example | | | | | Comparative Example | | |
|---|---|---|---|---|---|---|---|---|
| | 1 | 2 | 3 | 4 | 5 | 1 | 2 | 3 |
| Average particle diameter (μm): | 35.5 | 25.3 | 39.4 | 36.3 | 36.0 | 37.0 | 36.8 | 51.3 |
| Particle size distribution: | | | | | | | | |
| ≧88 μm (%) | 0.8 | 0 | 1.2 | 0.8 | 0.8 | 0.9 | 0.9 | 4.4 |
| ≧62 μm (%) | 7.7 | 25 | 8.7 | 8.2 | 8.1 | 10.1 | 10.0 | 25.0 |
| <22 μm (%) | 8.0 | 14.6 | 5.3 | 7.6 | 7.3 | 7.5 | 7.6 | 2.0 |
| <16 μm (%) | 0.5 | 0 | 0 | 0 | 0 | 0 | 0 | 2.8 |
| $S_1$ ($cm^2/g$): | 535 | 784 | 461 | 612 | 445 | 388 | 716 | 386 |
| $S_2$ ($cm^2/g$): | 367 | 516 | 331 | 359 | 362 | 353 | 354 | 254 |
| $S_1/S_2$: | 1.46 | 1.52 | 1.40 | 1.70 | 1.23 | 1.10 | 2.02 | 1.52 |
| Saturation mgtzn. (emu/g): | 67 | 66 | 65 | 66 | 65 | 66 | 66 | 66 |
| Residual mgtzn. (emu/g): | 0 | 0 | 0 | 0 | 0 | 0 | 0 | 0 |
| Coercive force (Oe): | 0 | 0 | 0 | 0 | 0 | 0 | 0 | 0 |
| Core material: | ← Cu—Zn-ferrite → | | | | | | | |
| Coat material:* | MMA | MMA-BA | MMA | MMA | MMA | MMA | MMA | MMA |
| Apparent density ($g/cm^3$): | 2.5 | 2.3 | 2.6 | 2.5 | 2.5 | 2.6 | 2.3 | 2.6 |
| Solid image uniformity: | AA | AA | AA | A | A | B | B | B |
| Highlight reproduction: | AA | AA | AA | AA | A | B | B | B |
| Fine-line reproduction: | AA | AA | AA | AA | A | B | B | B |
| Fog: | AA | AA | A | AA | A | B | B | B |
| Carrier adhesion: | AA | A | AA | A | AA | A | C | AA |

*MMA: Methyl methacrylate; BA: Butyl acrylate AA: Very good; A: Good; B: Average; C: Poor

Preparation of Carrier I

The preparation of Carrier A was repeated to obtain Carrier I, except that the coating resin material was replaced with MMA/BA.

Various properties of Carrier I thus obtained are shown in Table 2.

Preparation of Carriers J to L

The preparation of Carrier I was repeated to obtain Carriers J to L, respectively, except that the particle size distribution was changed as shown in Table 1.

Various properties of Carriers J to L thus obtained are shown in Table 2.

Example 6

| | |
|---|---|
| Polyester resin obtained by condensation of propoxylated bisphenol and fumaric acid | 100 parts |
| Phthalocyanine pigment | 4 parts |
| Chromium complex of di-tert-butylsalicylic acid | 4 parts |

The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The resulting finely pulverized product was classified by means of a multi-division classifier to select particle size in the range of 2 to 8 μm so that the particle size distribution of the present invention was brought about. Thus, colorant-containing resin particles were obtained.

To the resin particles thus obtained, 1.5% by weight of titanium oxide a having a hydrophobicity of 70%, an average particle diameter of 0.05 μm and a transmittance of 60% at 400 nm, which was obtained by mixing hydrophilic anatase type fine titanium oxide particles (particle diameter: 0.05 μm; BET specific surface area: 120 $m^2/g$) in an aqueous system with stirring during which n-$C_4H_9Si(OCH_3)_3$ was added and mixed while dispersing and hydrolyzing it in the aqueous system, so as to be in an amount of 20% by weight as solid content based on the fine titanium oxide particles and so as not to cause coalescence of particles, was added and blended using a Henschel mixer to obtain a cyan toner I having the particle size distribution as shown in Table 2.

Based on 7 parts of the above cyan toner I, Carrier I shown in Table 2 was blended in an amount making 100 parts in total weight, to obtain a developer. This Carrier I was a coated ferrite carrier whose particle surfaces had been coated with about 1% by weight of a methyl methacrylate/butyl acrylate (75/25) copolymer.

Using the developer thus obtained and using a commercially available color copying machine manufactured by Canon Inc. (CLC-500; comprising a developing sleeve with a built-in magnet roller comprised of five poles having a development main pole of 960 gauss), a running test was made in an environment of 23° C. and 60% RH.

Development was carried out under conditions set to be $V_{cont}$=400 V and $V_{back}$=−130 V.

As a result, good images with an image density of 1.4 to 1.5 were obtained, achieving a superior highlight reproduction and an image reproduction faithful to an original chart even after running on 10,000 sheets. During continuous copying, images were also obtained without causing any carrier adhesion and density variation, and the developer concentration was well and stably controllable.

Images were also reproduced in environments of temperature/humidity of 23° C./5% RH and 30° C./80% RH, respectively. As a result, as shown in Table 2, good results were obtained.

Example 7

Using a developer prepared in the same manner as in Example 6 except that the phthalocyanine pigment was replaced with quinacridone pigment, the titanium oxide a was replaced with a titanium oxide b having a hydrophobicity of 60%, an average particle diameter of 0.05 μm and a transmittance of 70% at 400 nm, treated using 15% by weight of n-$C_4H_9Si(OCH_3)_3$, to obtain Toner II shown in Table 2, and the carrier was replaced with Carrier J shown in Table 2, images were reproduced similarly. As a result, as shown in Table 2, good results were obtained.

Example 8

Using a developer prepared in the same manner as in Example 6 except that the titanium oxide was replaced with a titanium oxide c having a hydrophobicity of 65%, an average particle diameter of 0.05 μm and a transmittance of 65% at 400 nm, treated using 25% by weight of iso-$C_4H_9Si(OCH_3)_3$, to obtain a cyan toner III shown in Table 2 and this toner was blended with Carrier K in a toner concentration of 8%, images were reproduced similarly. As a result, is shown in Table 2, good results were obtained.

Comparative Example 3A

Using a developer prepared in the same manner as in Example 6 except that Carrier J used therein was blended with Toner IV shown in Table 2, in a toner concentration of 5%, images were reproduced similarly. As a result, as shown in Table 2, although the reproducibility of the original was slightly lowered, good results were obtained.

Example 10

Using a developer prepared in the same manner as in Example 6 except that the titanium oxide a was replaced with a commercially available hydrophobic silica (R972; Nippon Aerosil Co., Ltd.), images were reproduced similarly. As a result, as shown in Table 2, image quality was good and, although a difference in image density depending on environments was a little seen, it was at a level not problematic in practical use.

Comparative Example 4

Using a developer prepared in the same manner as in Example 6 except that Toner I used therein was blended with coarse-particle Carrier L shown in Table 2, in a toner concentration of 4%, images were reproduced similarly. As a result, as shown in Table 2, image density decreased.

Comparative Example 5

Using a developer prepared in the same manner as in Example 6 except that Toner V shown in Table 2, making use of no titanium oxide a used in Example 6, images were reproduced similarly. As a result, as shown in Table 2, image quality greatly deteriorated.

TABLE 2

| | Example | | | Comparative Example | Example | Comparative Example | |
|---|---|---|---|---|---|---|---|
| | 6 | 7 | 8 | 3A | 10 | 4 | 5 |
| Carrier: | I | J | K | I | I | L | I |
| Average particle diameter (μm): | 35.5 | 30.9 | 25.4 | 35.5 | 35.5 | 51.3 | 35.5 |
| Particle size distribution: | | | | | | | |
| ≧88 μm (%) | 0.8 | 0 | 0 | 0.8 | 0.8 | 4.4 | 0.8 |
| ≧62 μm (%) | 7.7 | 3.3 | 2.4 | 7.7 | 7.7 | 25.0 | 7.7 |
| <22 μm (%) | 8.0 | 11.3 | 15.4 | 8.0 | 8.0 | 2.0 | 8.0 |
| <16 μm (%) | 0.5 | 0 | 1.6 | 0.5 | 0.5 | 2.8 | 0.5 |
| $S_1$ ($cm^2/g$): | 540 | 587 | 776 | 540 | 540 | 380 | 540 |
| $S_2$ ($cm^2/g$): | 367 | 442 | 513 | 367 | 367 | 254 | 367 |
| $S_1/S_2$: | 1.47 | 1.39 | 1.51 | 1.47 | 1.47 | 1.50 | 1.47 |
| Magnetic properties | | | | | | | |
| Saturation mgtzn. (emu/g): | 67 | 65 | 66 | 67 | 67 | 66 | 67 |
| Residual mgtzn. (emu/g): | 0 | 0 | 0 | 0 | 0 | 0 | 0 |
| Coercive force (Oe): | 0 | 0 | 0 | 0 | 0 | 0 | 0 |
| Core material: | | | | ← Cu—Zn-ferrite → | | | |
| Coat material:* | MMA-BA | St-MMA | MMA | MMA-BA | MMA-BA | MMA-BA | MMA-BA |
| Apparent density ($g/cm^3$): | 2.5 | 2.6 | 2.3 | 2.5 | 2.5 | 2.5 | 2.5 |
| Toner: | I | II | III | IV | VI | I | V |
| Weight average particle diameter (μm): | 6.0 | 6.2 | 5.5 | 8.3 | 6.0 | 6.0 | 6.1 |
| Particle size distribution: | | | | | | | |
| ≦4 μm (% by number) | 16.0 | 21.2 | 32.4 | 8.3 | 16.2 | 16.0 | 17.2 |
| ≦5.04 μm (% by no.) | 45.4 | 50.6 | 60.1 | 17.6 | 45.6 | 45.4 | 45.7 |
| ≧8 μm (% by volume) | 7.2 | 10.3 | 4.7 | 43.6 | 7.2 | 7.2 | 7.4 |
| ≧10.08 μm (% by vol.) | 1.1 | 1.3 | 0.8 | 6.3 | 1.0 | 1.1 | 1.4 |
| Titanium oxide: | a | b | c | a | $SiO_2$ | a | — |
| Image density: | | | | | | | |
| 23° C./65% | 1.4–1.5 | 1.5–1.6 | 1.6–1.7 | 1.5–1.6 | 1.5–1.6 | 1.2–1.3 | 1.3–1.4 |
| 30° C./80% | 1.45–1.6 | 1.5–1.65 | 1.6–1.75 | 1.5–1.6 | 1.7–1.8 | — | — |
| 23° C./5% | 1.35–1.5 | 1.4–1.5 | 1.6–1.7 | 1.45–1.6 | 1.2–1.3 | — | — |
| Solid image uniformity: | A | A | A | A | A | B | C |
| Highlight reproduction: | A | AA | AA | AB | A | A | C |
| Fine-line reproduction: | A | AA | AA | AB | A | A | C |
| Running toner scatter: | AA | A | AB | A | B | B | C |
| Carrier adhesion: | A | AB | AA | AB | A | A | C |
| Fog: | AA | AA | A | AA | A | B | C |

*MMA: Methyl methacrylate; BA: Butyl acrylate; St: Styrene
AA: Very good; A: Good; AB: Intermediate between A & B; B: Average; C: Poor Example 11

| | |
|---|---|
| Polyester resin obtained by condensation of propoxylated bisphenol and fumaric acid | 100 parts |
| Phthalocyanine pigment | 4 parts |
| Chromium complex of di-tert-butylsalicylic acid | 4 parts |

The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The resulting finely pulverized product was classified by means of a multi-division classifier to select particle size in the range of 2 to 10 μm so that the particle size distribution of the present invention was brought about. Thus, colorantcontaining resin particles were obtained.

To the resin particles thus obtained, 1.0% by weight of titanium oxide having been made hydrophobic was added and blended using a Henschel mixer to obtain a cyan toner.

Based on 8 parts of the above cyan toner, Carrier M shown in Table 3 was blended in an amount making 100 parts in total weight, to obtain a developer. This Carrier M was a coated ferrite carrier whose particle surfaces had been coated with about 1% by weight of a methyl methacrylate/butyl acrylate (75/25) copolymer.

Using the developer thus obtained and using a commercially available color copying machine manufactured by Canon Inc. (CLC-500; comprising a developing sleeve with a built-in magnet roller comprised of five poles having a development main pole of 960 gauss), running tests were made in the same environments as in Example 1.

Development was carried out under conditions set to be $V_{cont}$=250 V and $V_{back}$=−150 V, where the developing electric field as shown in FIG. 1 was applied.

As a result, as shown in Table 3, good images were obtained, achieving a superior highlight reproduction and an image reproduction faithful to an original chart even after running on 30,000 sheets. During continuous copying, images were also obtained without causing any carrier adhesion and density variation, and the developer concentration was well and stably controllable.

Example 12

Using a developer prepared in the same manner as in Example 11 except that a toner in which the phthalocyanine pigment used in Example 11 was replaced with quinacridone pigment and the carrier was replaced with Carrier N shown in Table 3, images were reproduced Similarly. As a result, as shown in Table 3, good results were obtained.

Example 13

Using a developer prepared in the same manner as in Example 11 except that the carrier was replaced with Carrier O shown in Table 3, images were reproduced similarly. As a result, as shown in Table 3, the same good results were obtained at the initial state. Although highlight reproduction was slightly lower after running on 30,000 sheets than that in Example 11, good results were obtained.

Example 14

Using a developer prepared in the same manner as in Example 11 except that the carrier was replaced with Carrier P shown in Table 3, images were reproduced similarly. As a result, as shown in table 3, although solid-image uniformity was slightly lowered from the initial stage compared with that in Example 11, good results were obtained without causing carrier adhesion.

Example 15

Using a developer prepared in the same manner as in Example 11 except that the carrier was replaced with Carrier Q shown in Table 3, images were reproduced similarly. As a result, as shown in Table 3, although the latitude of carrier adhesion became narrower by about 10 V and $V_{back}$ became −140 V, good results with a superior highlight reproduction were obtained without causing fog.

Example 16

Using a developer prepared in the same manner as in Example 11 except that the carrier was replaced with Carrier R shown in Table 3, images were reproduced similarly. As a result, as shown in Table 3, although toner scatter was slightly seen after running on 30,000 sheets and highlight reproduction was also slightly lowered, good results were obtained.

Example 17

Using a developer prepared in the same manner as in Example 11 except that the carrier was replaced with Carrier S shown in Table 3, images were reproduced similarly. As a result, as shown in Table 3, although the latitude of carrier adhesion became narrower by about 20 V and $V_{back}$ became −130 V, good results with a superior highlight reproduction were obtained without causing fog.

Example 18

Figure 2:
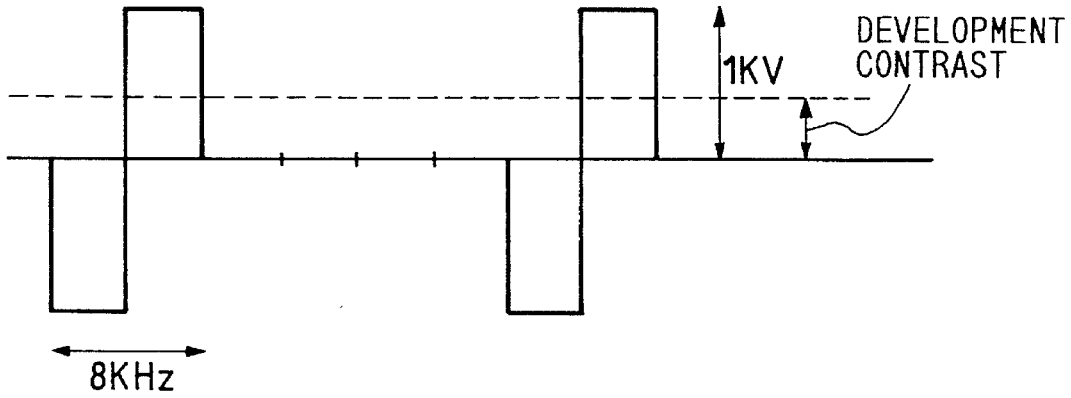
FIG. 2 shows a pattern of a discontinuous developing electric field used in Examples 18 and 21.

Images were reproduced in the same manner as in Example 11 except that the developing electric field as shown in FIG. 2 was applied as an alternating current. As a result, as shown in Table 3, good results were obtained.

Comparative Example 6

Using a developer prepared in the same manner as in Example 11 except that the carrier was replaced with Carrier T shown in Table 3, images were reproduced similarly. As a result, as shown in Table 3, images with a little poor highlight reproduction, solid image uniformity and so forth were obtained. Running further carried out on 30,000 sheets resulted in an increase in toner scatter and fog.

Comparative Example 7

Using a developer prepared in the same manner as in Example 11 except that the carrier was replaced with Carrier U shown in Table 3, images were reproduced similarly. As a result, as shown in Table 3, the latitude of carrier adhesion became narrower by about 40 V and it was impossible to set $V_{back}$ compatible with antifogging.

Example 19

Figure 5:
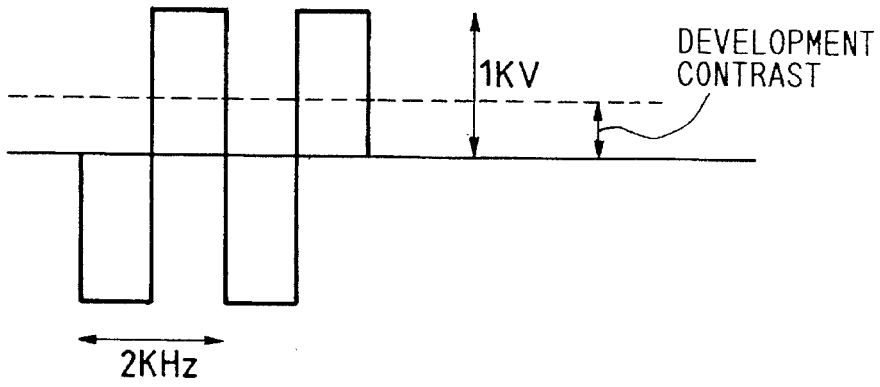
FIG. 5 shows a pattern of a continuous developing electric field used in Example 19 and Comparative Example 11.

Images were reproduced in the same manner as in Example 11 except that a developing electric field as shown in FIG. 5 was applied as an alternating current. As a result, as shown in Table 3, the latitude of carrier adhesion became narrower by about 30 V and also highlight reproduction was a little lowered, which, however, were each at a level not problematic in practical use.

TABLE 3

| | Example | | | | | | | Comparative Ex. | |
|---|---|---|---|---|---|---|---|---|---|
| | 11 | 12 | 13 | 14 | 15 | 16 | 17 | 6 | 7 |
| Carrier: | M | N | O | P | Q | R | S | T | U |
| Average particle diameter (μm): | 35.5 | 36.9 | 32.3 | 36.9 | 30.8 | 39.2 | 27.1 | 51.3 | 25.3 |
| Particle size distribution: | | | | | | | | | |
| ≧88 μm (%) | 0.8 | 0 | 0 | 0.8 | 0 | 1.6 | 0 | 4.4 | 0 |
| ≧62 μm (%) | 7.7 | 9.1 | 3.2 | 8.8 | 3.0 | 11.6 | 5.3 | 25.0 | 2.3 |
| <22 μm (%) | 8.0 | 6.8 | 9.2 | 6.8 | 10.7 | 7.8 | 14.3 | 2.0 | 17.6 |
| <16 μm (%) | 0.5 | 0 | 0 | 0 | 0 | 1.1 | 1.2 | 0.8 | 3.5 |
| $S_1$ ($cm^2/g$) | 536 | 507 | 561 | 490 | 593 | 470 | 702 | 364 | 781 |
| $S_2$ ($cm^2/g$) | 367 | 353 | 403 | 353 | 423 | 332 | 481 | 254 | 515 |
| $S_1/S_2$ | 1.46 | 1.44 | 1.39 | 1.39 | 1.40 | 1.42 | 1.46 | 1.43 | 1.52 |
| Saturation mgtzn. (emu/g): | 67 | 67 | 77 | 89 | 67 | 67 | 67 | 65 | 65 |
| Residual mgtzn. (emu/g): | 0 | 0 | 1.2 | 2.4 | 0 | 0 | 0 | 0 | 0 |
| Coercive force (Oe): | 0 | 0 | 14.7 | 28 | 0 | 0 | 0 | 0 | 0 |
| Core material: | Cu—Zn-ferrite | Cu—Zn-ferrite | Ni—Zn-ferrite | Magnetite | ← Cu—Zn-ferrite → | | | | |
| Coat material:* | MMA-BA | St-MMA | ← MMA-BA → | | | | | | |
| Apparent density ($g/cm^3$) | 2.5 | 2.6 | 2.2 | 2.5 | 2.2 | 2.4 | 1.9 | 2.5 | 2.1 |
| Solid image uniformity: | AA | AA | AA | B | AA | AA | AA | A | AA |
| Highlight reproduction: | AA | AA | A | A | AA | A | AA | A | AA |
| Fine-line reproduction: | AA | AA | AA | AA | AA | A | AA | A | AA |
| Running toner scatter: | AA | AA | AA | AA | AA | A | AA | B | AA |
| Carrier adhesion: | AA | AA | AA | AA | A | AA | B | A | C |
| Fog: | AA | AA | AA | AA | AA | AA | AA | B | AA |

* MMA: Methyl methacrylate; BA: Butyl acrylate; St: Styrene; AA: Very good; A: Good; B: Average; C: Poor

Example 20

| | |
|---|---|
| Polyester resin obtained by condensation of propoxylated bisphenol and fumaric acid | 100 parts |
| Phthalocyanine pigment | 4 parts |
| Chromium complex of di-tert-butylsalicylic acid | 2 parts |

The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The resulting finely pulverized product was classified by means of a multi-division classifier to select particle size in the range of 2 to 8 μm so that the particle size distribution of the present invention was brought about. Thus, colorant-containing resin particles were obtained.

To 100 parts by weight of the resin particles thus obtained, 1.0 part by weight of silica (BET specific surface area: 220 $m^2/g$) having been made hydrophobic using hexamethyldisilazane was externally added to obtain a cyan toner.

This cyan toner had the following average particle diameter and particle size distribution.

Weight average particle diameter: 6.0 μm

Particles of 4 μm or smaller: 16.1% by number

Particles of 5.04 μm or smaller: 45.3% by number

Particles of 8 μm or larger: 7.4% by volume

Particles of 10.08 μm or larger: 1.3% by volume

To toner thus formed, Cu-Zn-Fe ferrite particles surface-coated with a methyl methacrylatebutyl acrylate (75:25) copolymer were added to prepare a developer in a toner concentration of 4%.

Figure 3:
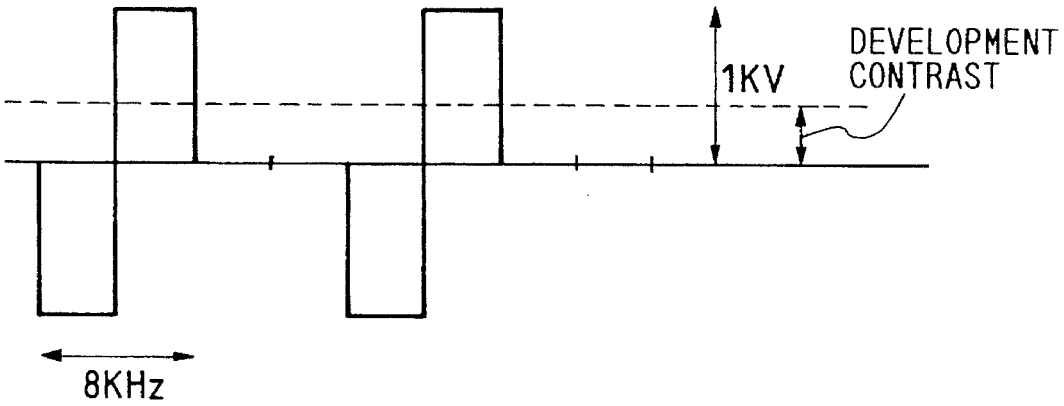
FIG. 3 shows a pattern of a discontinuous developing electric field used in Example 20.

Using the developer thus obtained and using a commercially available color copying machine (CLC-500, manufactured by Canon Inc.) in which a developing electric field was formed of a DC electric field, development contrast was set at 350 V and a discontinuous AC overlay electric field (developing electric field) as shown in FIG. 3 was applied, a 10,000 sheet running test was made in an environment of temperature/humidity of 23° C./60% RH.

As a result, as shown in Table 4, good sharp images with an image density of as stable as 1.40 to 1.50 were obtained without causing any fog at all.

Example 21

Images were reproduced in the same manner as in Example 20 except that a discontinuous AC electric field (developing electric field) as shown in FIG. 2 was applied. As a result, although image density became higher as a little as 1.5 to 1.65, vary stable and good images were obtained.

Examples 22 to 25 & Comparative Examples 8 to 10

Images were reproduced in the same manner as in Example 20 except that developers comprising toners having particle size distributions shown in Table 4 and development contrasts as also shown in Table 4 were used, respectively. Results obtained are shown together in Table 4.

TABLE 4

| | Weight average particle diameter (μm) | Particle size distribution ≦4 μm (%) by number | ≦5.04 μm (%) by number | ≧8 μm (%) by volume | ≧10.08 μm (%) by volume | Image density | Fog | Image quality | Development contrast | Toner concentration |
|---|---|---|---|---|---|---|---|---|---|---|
| Example: | | | | | | | | | | |
| 20 | 6.0 | 16.1 | 45.3 | 7.4 | 1.3 | 1.4–1.5 | AA | A | 350 V | 4% |
| 22 | 6.40 | 29.2 | 56.9 | 17.0 | 3.0 | 1.3–1.45 | AA | A | 350 V | 4% |
| 23 | 6.0 | 45.0 | 66.7 | 10.0 | 1.3 | 1.3–1.4 | A | A | 350 V | 4% |
| 24 | 5.23 | 51.0 | 78.6 | 3.2 | 0 | 1.4–1.5 | A | AA | 400 V | 3% |
| 25 | 6.26 | 23.7 | 51.1 | 10.8 | 1.3 | 1.35–1.45 | A | A | 350 V | 4% |
| Comparative Example: | | | | | | | | | | |
| 8 | 7.05 | 22.4 | 43.8 | 28.9 | 5.1 | 1.4–1.5 | AA | B | 300 V | 4% |
| 9 | 6.66 | 40.5 | 59.9 | 22.6 | 4.0 | 1.4–1.5 | A | B | 350 V | 4% |
| 10 | 6.80 | 12.6 | 33.4 | 18.9 | 1.7 | 1.4–1.5 | AA | B | 350 V | 4% |

AA: Very good
A: Good
B: Not problematic

Example 26

Figure 4:
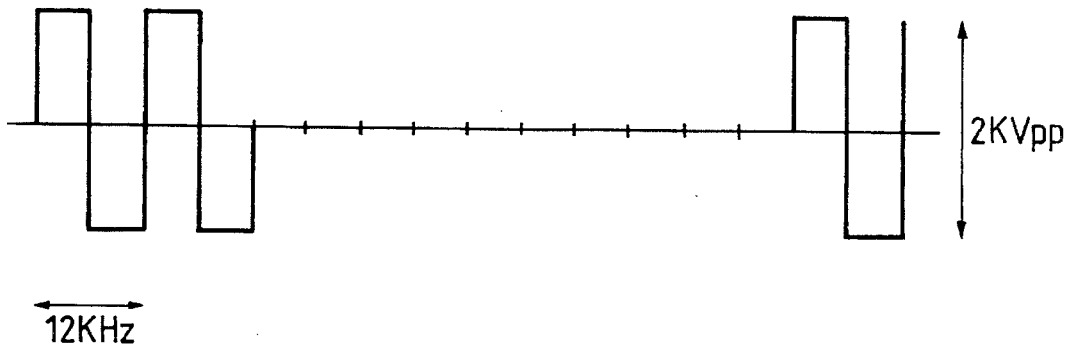
FIG. 4 shows a pattern of a discontinuous developing electric field used in Example 26.

Images were reproduced in the same manner as in Example 20 except that a discontinuous AC electric field (developing electric field) as shown in FIG. 4 was applied. As a result, images with a high quality were obtained, having achieved photographic image halftone reproduction superior to that of Example 20.

Comparative Example 11

Images were reproduced in the same manner as in Example 20 except that the developing electric field shown in FIG. 3 was replaced with a developing electric field shown in FIG. 5. As a result, fog began to occur on about 3,000th sheet copying and thereafter. On about 5,000th sheet copying, image density also was lowered and hence the running test was stopped.

Preparation of Carriers V to Y

The preparation of Carrier A was repeated to respectively obtain Carriers V to Y having particle size distributions as shown in Table 5, except that the coating resin material was replaced with materials also shown in Table 5.

Various properties Of Carriers V to Y thus obtained are shown in Table 5.

Example 27

| | |
|---|---|
| Polyester resin obtained by condensation of propoxylated bisphenol and fumaric acid | 100 parts |
| Phthalocyanine pigment | 5 parts |
| Chromium complex of di-tert-butylsalicylic acid | 4 parts |

The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The resulting finely pulverized product was classified to obtain colorant-containing resin particles having the particle size distribution of the present invention.

To the resin particles thus obtained, 1.5% by weight of titanium oxide having a hydrophobicity of 70%, an average particle diameter of 0.05 μm and a transmittance of 60% at 400 nm, which was obtained by mixing hydrophilic anatase type fine titanium oxide particles (particle diameter: 0.05 μm; BET specific surface area: 120 $m^2/g$) in an aqueous system with stirring during which $n\text{-}C_4H_9Si(OCH_3)_3$ was added and mixed as a treating agent dispersed in the aqueous system, so as to be in an amount of 20% by weight as solid content based on the fine titanium oxide particles and so as not to cause coalescence of particles, was added and blended using a Henschel mixer to obtain a cyan toner Toner A shown in Table 6.

Based on 5 parts of this cyan toner, Carrier V which was a Cu-Zn-Fe ferrite carrier whose particle surfaces had been coated with 0.5% by weight of a copolymer composed of 50% of styrene, 20% of methyl methacrylate and 30% of 2-ethylhexyl acrylate was blended in an amount making 100 parts in total weight, to obtain a two-component type developer.

Using the two-component type developer thus obtained and using a commercially available color copying machine manufactured by Canon Inc. (CLC-500; comprising a developing sleeve with a built-in magnet roller comprised of five poles having a development main pole of 960 gauss), a running test was made in an environment of temperature/humidity of 23° C./60% RH.

Development was carried out under conditions set to be $V_{cont}$=300 V and $V_{back}$=−130 V.

As a result, good images with an image density of 1.4 to 1.5 were obtained, achieving a superior highlight reproduction and an image reproduction faithful to an original chart even after running on 10,000 sheets. During continuous copying, images were also obtained without causing any carrier adhesion and density variation, and the developer concentration was well and stably controllable.

Images were also reproduced in environments of temperature/humidity of 23° C./5% RH and 30° C./80% RH, respectively. Results obtained are shown in Table 7.

Example 28

Using a developer prepared in the same manner as in Example 27 except that Carrier V used therein was replaced with Carrier W shown in Table 5, images were reproduced similarly. As a result, as shown in Table 7, good results were obtained.

Example 29

Red resin particles were obtained in the same manner as in Example 27 except that the phthalocyanine pigment used therein was replaced with quinacridone pigment.

Using a developer prepared in the same manner as in Example 27 except that the fine titanium oxide particles I used therein was externally added in an amount of 2.0 parts based on 100 parts of the above red resin particles to obtain a magenta toner Toner F shown in Table 6, images were reproduced similarly. As a result, as shown in Table 7, the good results were obtained.

Example 30

Example 27 was repeated except that the anatase type titanium oxide used therein was replaced with a titanium oxide II having a hydrophobicity of 60%, an average particle diameter of 0.05 μm and a transmittance of 56% at 400 nm, treated using 18 parts of $n\text{-}C_6H_{13}Si(OCH_3)_3$, to obtain a cyan toner Toner G shown in Table 6. As a result, as shown in Table 7, good results were obtained.

Example 31

Example 27 was repeated except that the anatase type titanium oxide used therein was replaced with a titanium oxide III having a hydrophobicity of 70%, an average particle diameter of 0.05 μm and a transmittance of 50% at 400 nm, treated using 16 parts of $n\text{-}C_{10}H_{21}Si(OCH_3)_3$, to obtain a cyan toner Toner H shown in Table 6. As a result, although image density became lower as a little as 1.20 to 1.35 in an environment of temperature/humidity of 23° C./5% Rh, good results were obtained.

Comparative Example 11A

Using a developer prepared in the same manner as in Example 27 except that a cyan toner Toner B having a particle size distribution shown in Table 6 was blended with Carrier V in a toner concentration of 6% (the external additive was in an amount of 1% by weight), images were reproduced similarly. As a result, images with a high density were obtained. Highlight reproduction became a little lower, which, however, was at a level not problematic in practical use.

Comparative Example 11B

Using a developer prepared in the same manner as in Example 27 except that a cyan toner Toner C having a particle size distribution shown in Table 6 was used, images were reproduced similarly. As a result, no carrier adhesion occurred, but solid image uniformity and highlight reproduction became lower and toner scatter and fog a little occurred, which, however, were at levels not problematic in practical use.

Comparative Example 11C

Using a developer prepared in the same manner as in Example 27 except that a cyan toner Toner D having a particle size distribution shown in Table 6 was blended with Carrier V in a toner concentration of 8% (the external additive was in an amount of 0.6% by weight), images were reproduced similarly. As a result, images with a high density were obtained. Resolution became lower to cause a little coarse images, which, however, was at a level not problematic in practical use.

Comparative Example 11D

Using a developer prepared in the same manner as in Example 27 except that a cyan toner Toner E having a particle size distribution shown in Table 6 was blended with Carrier V in a toner concentration of 7% (the external additive was in an amount of 1.5%, the same as in Example 27), images were reproduced similarly. As a result, although there was no problem at all in respect of image density, a little coarse images were formed at highlight areas, which, however, were at a level not problematic in practical use.

Comparative Example 12

Using a developer prepared in the same manner as in Example 27 except that Carrier V used therein was replaced with Carrier X shown in Table 5, images were reproduced similarly. As a result, toner scatter seriously occurred from the initial stage of the running and hence the running test was stopped.

Comparative Example 13

Using a developer prepared in the same manner as in Example 27 except that Carrier V used therein was replaced with Carrier Y shown in Table 5, images were reproduced similarly. As a result, carrier adhesion seriously occurred, and it was impossible to make free of this even though the value of $V_{back}$ was increased or the toner concentration was changed.

TABLE 5

| Carrier | Core material | Magnetic properties (1) | (2) | (3) | Coat matereal | $S_1$ (cm²/g) | $S_2$ (cm²/g) | $S_1/S_2$ | Av. particle diam. | Particle size distribution <16 μm (%) | <22 μm (%) | 22–62 μm (%) | ≧62 μm (%) | ≧88 μm (%) | Apparent density (g/cm³) |
|---|---|---|---|---|---|---|---|---|---|---|---|---|---|---|---|
| V | Cu—Zn-ferrite | 67 | 0 | 0 | St-MMA-2EHA | 522 | 362 | 1.44 | 36.0 | 0 | 5.2 | 87.3 | 7.5 | 0.2 | 2.15 |
| W | Cu—Zn-ferrite | 67 | 0 | 0 | St-MMA | 512 | 351 | 1.46 | 37.2 | 0 | 4.8 | 86.5 | 8.7 | 0.4 | 2.14 |
| X | Cu—Zn- | 67 | 0 | 0 | St- | 320 | 253 | 1.26 | 51.5 | 0 | 1.1 | 74.0 | 24.9 | 5.7 | 2.49 |

TABLE 5-continued

| Carrier | Core material | Magnetic properties (1) | (2) | (3) | Coat matereal | $S_1$ (cm²/g) | $S_2$ (cm²/g) | $S_1/S_2$ | Av. particle diam. | Particle size distribution <16 μm (%) | <22 μm (%) | 22–62 μm (%) | ≧62 μm (%) | ≧88 μm (%) | Apparent density (g/cm³) |
|---|---|---|---|---|---|---|---|---|---|---|---|---|---|---|---|
| Y | ferrite Cu—Zn-ferrite | 67 | 0 | 0 | MMA-2EHA St-MMA-2EHA | 658 | 468 | 1.41 | 27.9 | 1.2 | 21.8 | 78.2 | 0 | 0 | 2.00 |

(1): Saturation magnetization. (emu/g)
(2): Residual magnetization (emu/g)
(3): Coercive force (Oe):

TABLE 6

| Toner | Weight average particle diameter (μm) | $S_A$ (m²/g) | $S_B$ (m²/g) | $S_B/S_A$ | Particle size distribution ≦4 μm (%) by number | ≦5.04 μm (%) by number | ≧8 μm (%) by volume | ≧10.08 μm (%) by volume | External additive |
|---|---|---|---|---|---|---|---|---|---|
| A | 6.08 | 0.90 | 1.15 | 1.28 | 16.8 | 45.0 | 5.4 | 0 | I |
| B | 8.29 | 0.66 | 1.20 | 1.82 | 26.7 | 48.8 | 57.3 | 7.2 | I |
| C | 4.50 | 1.24 | 1.72 | 1.38 | 68.8 | 95.7 | 0 | 0 | I |
| D | 8.59 | 0.63 | 0.93 | 1.48 | 9.1 | 21.4 | 51.5 | 7.7 | I |
| E | 6.00 | 0.91 | 1.08 | 1.19 | 3.2 | 47.3 | 2.2 | 0 | I |
| F | 6.28 | 0.87 | 1.12 | 1.29 | 18.5 | 42.9 | 7.2 | 0.7 | I |
| G | 6.08 | 0.90 | 1.15 | 1.28 | 16.8 | 45.0 | 5.4 | 0 | II |
| H | 6.08 | 0.90 | 1.15 | 1.28 | 16.8 | 45.0 | 5.4 | 0 | III |

TABLE 7

| | Toner | Carrier | External additive | Image density 23° C./5% RH | 30° C./80% RH | | Solid image uniformity | High-light reproduction | Toner scatter | Fog | Carrier adhesion |
|---|---|---|---|---|---|---|---|---|---|---|---|
| Example: | | | | | | | | | | | |
| 27 | A | V | I | 1.35–1.45 | 1.50–1.60 | 1.55–1.65 | A | AA | A | A | A |
| 28 | A | W | I | 1.35–1.50 | 1.50–1.60 | 1.50–1.70 | A | AA | A | A | A |
| 29 | F | V | I | 1.30–1.40 | 1.40–1.55 | 1.45–1.60 | A | AA | A | A | A |
| 30 | G | V | II | 1.30–1.40 | 1.40–1.55 | 1.50–1.65 | A | AA | A | A | A |
| 31 | H | V | III | 1.20–1.35 | 1.35–1.40 | 1.40–1.45 | A | A | A | A | A |
| Comparative Example 11A | B | V | I | 1.35–1.55 | 1.50–1.70 | 1.60–1.80 | B | B | A | B | A |
| Comparative Example 11B | C | V | I | 1.15–1.25 | 1.20–1.35 | 1.25–1.40 | B | B | B | B | A |
| Comparative Example 11C | D | V | I | 1.35–1.55 | 1.45–1.65 | 1.5–1.65 | B | B | A | A | A |
| Comparative Example 11D | E | V | I | 1.35–1.45 | 1.50–1.60 | 1.55–1.65 | A | B | A | A | A |
| Comparative Example: | | | | | | | | | | | |
| 12 | A | X | I | — | — | — | A | A | C | C | A |
| 13 | A | Y | I | — | — | — | B | A | A | B | C |

What is claimed is:

1. A two-component type developer comprising a toner and a carrier, said toner containing toner particles and an external additive, and said carrier comprising carrier particles, wherein said toner has a weight average particle diameter of from 3 μm to 7 μm; and contains more than 40% by number of toner particles with a particle diameter of 5.04 μm or smaller, from 10% to 70% by number of toner particles with a particle diameter of 4 μm or smaller, and from 2% to 20% by volume of toner particles with a particle diameter of 8 μm or larger, and said carrier has a 50% particle diameter ($D_{50}$) of from 15 μm to 45 μm; said carrier contains from 1% to 20% of carrier particles with a size smaller than 22 μm, not more than 3% of carrier particles with a size smaller than 16 μm, from 2% to 15% of carrier particles with a size of 62 μm or larger, and not more than 2% of carrier particles with a size of 88 μm or larger; and said carrier has a specific surface area $S_1$ as measured by an air-permeability method and a specific surface area $S_2$ as calculated by the following expression:

$$S_2=(6/\rho.D_{50})\times10^4$$

wherein ρ is a specific gravity of carrier; satisfying the following condition:

$$1.2\leqq S_1/S_2\leqq 2.0.$$

2. A two-component type developer according to claim 1, wherein said carrier contains from 2% to 15% of the Carrier particles with a size smaller than 22 μm, and not more than 2% of the carrier particles with a size smaller than 16 μm.

3. A two-component type developer according to claim 1, wherein said carrier contains from 4% to 15% Of the carrier particles with a size smaller than 22 μm, and not more than 1% of the carrier particles with a size smaller than 16 μm.

4. A two-component type developer according to claim 1, wherein said carrier has the specific surface area $S_1$ and the specific surface area $S_2$ satisfying the following condition:

$$1.3\leqq S_1/S_2\leqq 1.8.$$

5. A two-component type developer according to claim 1, wherein said carrier has the specific surface area $S_1$ and the specific surface area $S_2$ satisfying the following condition:

$$1.4\leqq S_1/S_2\leqq 1.7.$$

6. A two-component type developer according to claim 1, wherein said carrier has a saturation magnetization of from 35 emu/g to 90 emu/g, a residual magnetization of 10 emu/g or less and a coercive force of 40 oersteds or less, in an applied magnetic field of 3,000 oersteds.

7. A two-component type developer according to claim 1, wherein said carrier has a saturation magnetization of from 35 emu/g to 90 emu/g, a residual magnetization of 10 emu/g or less and a coercive force of 30 oersteds or less, in an applied magnetic field of 3,000 oersteds.

8. A two-component type developer according to claim 1, wherein said carrier has a residual magnetization of 5 emu/g or less and a coercive force of 30 oersteds or less, in an applied magnetic field of 3,000 oersteds.

9. A two-component type developer according to claim 1, wherein particle surfaces of said carrier are coated with a coating resin.

10. A two-component type developer according to claim 1, wherein said carrier has a specific surface area $S_1$ as measured by an air-permeability method within the range of;

$$350\leqq S_1\leqq 600\ cm^2/g$$

and said carrier contains from 1% to 20% of the carrier particles with a size smaller than 22 μm, not less than 75% of carrier particles with a size of from 22 μm to less than 62 μm and from 2% to 15% of the carrier particles with a size of 62 μm or larger.

11. A two-component type developer according to claim 1, wherein said carrier has a specific surface area $S_1$ as measured by an air-permeability method within the range of;

$$380\leqq S_1\leqq 550\ cm^2/g$$

and said carrier contains from 2% to 15% of the carrier particles with a size smaller than 22 μm, not less than 78% of the carrier particles with a size of from 22 μm to less than 62 μm and from 4% to 13% of the carrier particles with a size of 62 μm or larger.

12. A two-component type developer according to claim 10, wherein said carrier has a saturation magnetization of from 35 emu/g to 90 emu/g, a residual magnetization of 10 emu/g or less and a coercive force of 40 oersteds or less, in an applied magnetic field of 3,000 oersteds.

13. A two-component type developer according to claim 10, wherein said carrier has a residual magnetization of 5 emu/g or less and a coercive force of 30 oersteds or less, in an applied magnetic field of 3,000 oersteds.

14. A two-component type developer according to claim 10, wherein said carrier has an apparent density of from 1.8 $g/cm^3$ to 3.2 $g/cm^3$.

15. A two-component type developer according to claim 1, wherein said toner has a weight average particle diameter of from 3 μm to 7 μm; and contains more than 40% by number to not more than 90% by number of toner particles with a particle diameter of 5.04 μm or smaller, from 15% to 60% by number of toner particles with a particle diameter of 4 μm or smaller, from 3.0% to 18.0% by volume of toner particles with a particle diameter of 8 μm or larger, and not more than 4% by volume of toner particles with a particle diameter of 10.08 μm or larger.

16. A two-component type developer according to claim 1, wherein said external additive comprises fine titanium oxide particles.

17. A two-component type developer according to claim 16, wherein said fine titanium oxide particles comprise anatase type fine titanium oxide particles.

18. A two-component type developer according to claim 16, wherein said fine titanium oxide particles are surface-treated with a coupling agent.

19. A two-component type developer according to claim 18, wherein said fine titanium oxide particles are surface-treated while hydrolyzing a coupling agent in an aqueous system.

20. A two-component type developer according to claim 16, wherein said fine titanium oxide particles have a hydrophobicity of from 20% to 98%.

21. A two-component type developer according to claim 16, wherein said fine titanium oxide particles have a hydrophobicity of from 30% to 90%.

22. A two-component type developer according to claim 1, wherein said toner satisfies the following condition:

$$1.0\leqq S_B\leqq 1.8\ (m^2/g),$$

$$1.20\leqq S_B/S_A\leqq 1.70$$

wherein $S_A$ is a specific surface area directly calculated from a weight average particle diameter of toner calculated from volume average distribution data of a Coulter counter and $S_B$ is a specific surface area calculated from number average distribution data of a Coulter counter;
and said toner contains from 10% to 70% by number of toner particles with a particle diameter of 4.0 μm or smaller.

23. A two-component type developer according to claim 1, wherein said toner satisfies the following condition:

$$1.05\leqq S_B\leqq 1.7\ (m^2/g),$$

$$1.20\leqq S_B/S_A\leqq 1.60$$

wherein $S_A$ is a specific surface area directly calculated from a weight average particle diameter of toner calculated from volume average distribution data of a Coulter counter and $S_B$ is a specific surface area of toner calculated from number average distribution data of a Coulter counter;

and said toner contains from 15% to 60% by number of toner particles with a particle diameter of 4.0 μm or smaller.

24. A two-component type developer according to claim 1, wherein said carrier has a saturation magnetization of from 35 emu/g to 90 emu/g, a residual magnetization of 10 emu/g or less, a coercive force of 40 oarsteds or less in an applied magnetic field of 3,000 oarsteds; and said toner contains colorant-containing resin particles and fine titanium oxide particle, has a weight average particle diameter of from 3 μm to 7 μm, and contains more than 40% by number of toner particles with a particle diameter of 5.04 Zμm or smaller, from 10% to 70% by number of toner particles with a particle diameter of 4 μm or smaller, from 2% to 20% by volume of toner particles with a particle diameter of 8 μm or larger, and not more than 6% by volume of toner particles with a particle diameter of 10.08 μm or larger.

25. A two-component type developer according to claim 1, wherein;

said carrier has a specific surface area S1 as measured by an air-permeability method within the range $$350 \leqq S_1 \leqq 600 \text{ cm}^2/\text{g}$$

and said carrier contains from 1% to 20% of the carrier particles with a size smaller than 22 μm, not less than 75% of carrier particles with a size of from 22 μm to less than 62 μm and from 2% to 15% of the carrier particles with a size of 62 μm or larger; and said toner satisfies the following condition:

$$1.0 \leqq S_B \leqq 1.8 \text{ (m}^2/\text{g)},$$

$$1.20 \leqq S_B/S_A \leqq 1.70$$

wherein $S_A$ is a specific surface area directly calculated from a weight average particle diameter of toner calculated from volume average distribution data of a Coulter counter and $S_B$ is a specific surface area calculated from number average distribution data of a Coulter counter;

and contains from 10% to 70% by number of toner particles with a particle diameter of 4.0 μm or smaller.

26. A two-component type developer according to claim 1, wherein said toner contains not more than 6% by volume of toner particles with a particle diameter of 10.08 μm or larger.

* * * * *

UNITED STATES PATENT AND TRADEMARK OFFICE

CERTIFICATE OF CORRECTION

PATENT NO. : 5,512,402

DATED : April 30, 1996

INVENTOR(S) : KENJI OKADO ET AL.

It is certified that error appears in the above-identified patent and that said Letters Patent is hereby corrected as shown below:

AT [57] ABSTRACT

Line 11, "+EA" should be deleted.

COLUMN 3

Line 20, "toner-Carrier" should read --toner-carrier--.
Line 21, "bluffed" should read --blurred--.
Line 56, "Of" should read --of--.

COLUMN 5

Line 24, "macklines" should read --machines--.

COLUMN 6

Line 19, "bluffed" should read --blurred-.
Line 29, "triboelectrio" should read --triboelectric--.

COLUMN 7

Line 18, "comprising;" should read --comprising:--.
Line 21, "boared" should read --carried--.
Line 23, "in" should read --on--.
Line 25, "wherein;" should read --wherein:--.
Line 43, "comprising;" should read --comprising--.
Line 55, "beared" should read --carried--.
Line 57, "wherein;" should read --wherein:--.

UNITED STATES PATENT AND TRADEMARK OFFICE

CERTIFICATE OF CORRECTION

PATENT NO. : 5,512,402

DATED : April 30, 1996

INVENTOR(S) : KENJI OKADO ET AL.

It is certified that error appears in the above-identified patent and that said Letters Patent is hereby corrected as shown below:

COLUMN 9

Line 42, "oarsteds" should read --oersteds--.
Line 58, "mathacrylic" should read --methacrylic--.

COLUMN 10

Line 16, "nikel," should read --nickel,--.
Line 28, "developed" should read --developer--.
Line 29, "toned" should read --toner--.
Line 38, "mole" should read --more--.
Line 52, "have" (first occurrence) should read --has--.

COLUMN 13

Line 61, "whatever" should read --whenever--.
Line 63, "has" should read --have--.

COLUMN 14

Line 11, "ariarase" should read --anatase--.
Line 19, "materials" should read --material--.
Line 28, "AS" should read --As--.

COLUMN 15

Line 25, "of;" should read --of:--.

UNITED STATES PATENT AND TRADEMARK OFFICE

CERTIFICATE OF CORRECTION

PATENT NO. : 5,512,402

DATED : April 30, 1996

INVENTOR(S) : KENJI OKADO ET AL.

It is certified that error appears in the above-identified patent and that said Letters Patent is hereby corrected as shown below:

COLUMN 16

Line 35, "Colorless" should read --colorless--.
Line 46, "Fhodamine" should read --rhodamine--.
Line 47, "of" should read --or--.
Line 48, "Color" should read --color--.

COLUMN 17

Line 10, "S1" should read --$S_1$--.
Line 12, "of;" should read --of:--.
Line 62, "of;" should read --of:--.

COLUMN 18

Line 7, "truely" should read --truly--.

COLUMN 19

Line 12, "dan" should read --can--.
Line 38, "describe" should read --described--.
Line 42, "$350 \leq S1 \leq 600 cm^2 g$," should read --$350 \leq S_1 \leq 600 cm^2 g$ --.
Line 48, "increase" should read --increases--.
Line 52, "also" should be deleted.
Line 58, "brusk" should read --brush--.

UNITED STATES PATENT AND TRADEMARK OFFICE

CERTIFICATE OF CORRECTION

PATENT NO. : 5,512,402

DATED : April 30, 1996

INVENTOR(S) : KENJI OKADO ET AL.

It is certified that error appears in the above-identified patent and that said Letters Patent is hereby corrected as shown below:

COLUMN 20

Line 1, "increase" should read --increases--.
Line 34, "beared" should read --carried--.
Line 51, "beared" should read --carried--.
Line 59, "Carrying" should read --carrying--.

COLUMN 21

Line 12, "beared" should read --carried--.
Line 55, "fine powder carrier." should read --fine powder present in the carrier.--.

COLUMN 22

Line 34, "Upper" should read --upper--.
Line 41, "Other" should read --other--.

COLUMN 23

Line 9, "Of" should read --of--.
Line 10, "in" should read --into--.
Line 20, "beared" should read --carried--.
Line 41, "as" should read --was--.
Line 66, "sunisoidal" should read --sinusoidal--.

COLUMN 24

Line 55, "beared" should read --carried--.

UNITED STATES PATENT AND TRADEMARK OFFICE

CERTIFICATE OF CORRECTION

PATENT NO. : 5,512,402

DATED : April 30, 1996

INVENTOR(S) : KENJI OKADO ET AL.

It is certified that error appears in the above-identified patent and that said Letters Patent is hereby corrected as shown below:

COLUMN 25

Line 13, "beared" should read --carried--.

COLUMN 26

Line 3, "pull" should read --pulled--.
Line 26, "(cm2/g);" should read --($cm^2$/g);--.

COLUMN 28

Line 19, "manufacture" should read --manufactured--.

COLUMN 29

Line 31, "colorantcontaining" should read --colorant-containing--.

COLUMN 30

Line 18, "AS" should read --As--.
Line 57, "large" should read --large a--.

COLUMN 31

Line 18, "←Cu—Zn-ferrite→" should read -- ←Cu-Zn-ferrite→ --.

COLUMN 33

Line 14, "is" should read --as--.

UNITED STATES PATENT AND TRADEMARK OFFICE

CERTIFICATE OF CORRECTION

PATENT NO. : 5,512,402

DATED : April 30, 1996

INVENTOR(S) : KENJI OKADO ET AL.

It is certified that error appears in the above-identified patent and that said Letters Patent is hereby corrected as shown below:

COLUMN 34

Line 40, "←Cu—Zn-ferrite→" should read -- ←Cu-Zn-ferrite→ --.

COLUMN 35

Line 17, "colorantcontaining" should read --colorant-containing--.
Line 51, "Similarly." should read --similarly.--.

COLUMN 37

Line 17, "Cu—Zn-ferrite" (both occurrences) should read --Cu-Zn-ferrite-- and "Ni—Zn-ferrite" should read --Ni-Zn-ferrite--.
Line 60, "methacrylatebutyl" should read --methacrylate-butyl--.

COLUMN 38

Line 17, "←Cu—Zn-ferrite→" should read -- ←Cu-Zn-ferrite→ --.
Line 54, "as a little" should read --as little--.
Line 55, "vary" should read --very--.

COLUMN 41

Line 36, "as a little" should read --as little--.
Line 61, "matereal" should read --material--.

UNITED STATES PATENT AND TRADEMARK OFFICE

CERTIFICATE OF CORRECTION

PATENT NO. : 5,512,402

DATED : April 30, 1996

INVENTOR(S) : KENJI OKADO ET AL.

It is certified that error appears in the above-identified patent and that said Letters Patent is hereby corrected as shown below:

COLUMN 42

Lines 7-8, "a little occurred" should read --occurred a little--.

COLUMN 43

Line 9, "matereal" should read --material--.
Line 42, "23° C./5% RH 30°C./80% RH" should read --23° C./5% RH 23°C./60% RH 30°C./80% RH--.

COLUMN 45

Line 19, "Carrier" should read --carrier--.
Line 23, "Of" should read --of--.
Line 56, "of;" should read --of:--.
Line 67, "of;" should read --of:--.

COLUMN 46

Line 6, "62" should be in lightface type.

UNITED STATES PATENT AND TRADEMARK OFFICE

CERTIFICATE OF CORRECTION

PATENT NO. : 5,512,402

DATED : April 30, 1996

INVENTOR(S) : KENJI OKADO ET AL.

It is certified that error appears in the above-identified patent and that said Letters Patent is hereby corrected as shown below:

COLUMN 47

Line 9, "oarsteds" should read --oersteds--.
Line 10, "oarsteds;" should read --oersteds;--.
Line 12, "particle," should read --particles,--.
Line 14, "5.04 Zμm" should read --5.04 μm--.
Line 21, "wherein;" should read --wherein:--.
Line 22, "S1" should read --$S_1$--.
Line 23, "range" should read --range of:--.

Signed and Sealed this

Seventh Day of January, 1997

*Attest:*

*Attesting Officer*

BRUCE LEHMAN

*Commissioner of Patents and Trademarks*